US011161162B2

(12) United States Patent
Smair

(10) Patent No.: US 11,161,162 B2
(45) Date of Patent: Nov. 2, 2021

(54) METHOD AND APPARATUS FOR FORMING A HELICAL TYPE FLIGHT

(71) Applicant: Robo Helix Pty Limited, Wollongong (AU)

(72) Inventor: Hayel Smair, Carlingford (AU)

(73) Assignee: Robo Helix Pty Limited, Wollongong (AU)

( * ) Notice: Subject to any disclaimer, the term of this patent is extended or adjusted under 35 U.S.C. 154(b) by 212 days.

(21) Appl. No.: 16/085,937

(22) PCT Filed: Mar. 17, 2017

(86) PCT No.: PCT/AU2017/050236
§ 371 (c)(1),
(2) Date: Sep. 17, 2018

(87) PCT Pub. No.: WO2017/156587
PCT Pub. Date: Sep. 21, 2017

(65) Prior Publication Data

US 2019/0099794 A1 Apr. 4, 2019

(30) Foreign Application Priority Data

Mar. 18, 2016 (AU) ..... 2016901014

(51) Int. Cl.
*B21D 11/06* (2006.01)
*B21D 25/04* (2006.01)
(Continued)

(52) U.S. Cl.
CPC ..... *B21D 11/06* (2013.01); *B21C 37/26* (2013.01); *B21D 11/14* (2013.01); *B21D 25/00* (2013.01); *B21D 25/04* (2013.01)

(58) Field of Classification Search
CPC ..... B21D 11/06; B21D 11/14; B21D 25/04; B21D 25/00; B21C 37/26; B25B 5/14; B25B 5/16
(Continued)

(56) References Cited

U.S. PATENT DOCUMENTS 2,902,080 A * 9/1959 Fuchs, Jr. ..... B21D 11/14 72/299
3,485,116 A 12/1969 Fender
(Continued)

FOREIGN PATENT DOCUMENTS

CN 1283140 A 2/2001
CN 102248049 A 11/2011
(Continued)

OTHER PUBLICATIONS

Collet Set, For Sale on Amazon.com Available Aug. 19, 2014. Retrieved date Aug. 13, 2020.*
(Continued)

*Primary Examiner* — Adam J Eiseman
*Assistant Examiner* — Mohammed S. Alawadi
(74) *Attorney, Agent, or Firm* — Kilpatrick Townsend & Stockton LLP

(57) ABSTRACT

Apparatus for use in the formation of a helical screw flight, the apparatus comprising: a drive first and second support heads arranged for relative axial movement with respect to one another in a direction of a main axis in response to actuation of the drive the first and second support heads being configured so as to be able to provide for a plurality of position adjustments including a lateral position adjustment whereby the first and second support heads can be displaced or moved laterally with respect to the main axis in a direction of respective lateral axes and a rotational position adjustment wherein at least one of the first and second work
(Continued)

heads can be rotated about a rotation axis which extends in a direction generally parallel to coaxial with the main axis.

19 Claims, 27 Drawing Sheets

(51) Int. Cl.
*B21C 37/26* (2006.01)
*B21D 25/00* (2006.01)
*B21D 11/14* (2006.01)

(58) Field of Classification Search
USPC ..... 72/64, 65, 371, 299
See application file for complete search history.

(56) References Cited

U.S. PATENT DOCUMENTS 4,827,753 A * 5/1989 Moroney ..... B21D 11/02 72/296
6,443,040 B1 * 9/2002 Marchesini ..... B21C 37/26 29/890.048
2014/0196515 A1 * 7/2014 Bloxham ..... B21D 11/14 72/67

FOREIGN PATENT DOCUMENTS

| | | | |
|---|---|---|---|
| CN | 204583956 | U | 8/2015 |
| JP | H04105715 | A | 4/1992 |
| JP | 2005052851 | A | 3/2005 |
| WO | 99/32240 | A1 | 7/1999 |
| WO | 2013003903 | A1 | 1/2013 |
| WO | 2016/120582 | A1 | 8/2016 |
| WO | 2017/156587 | A1 | 9/2017 |

OTHER PUBLICATIONS

International Search Report and Written Opinion for PCT/AU2017/050236 dated May 9, 2017, 9 pages.
First Office Action for Chinese Application No. 201780030250.1 dated Oct. 30, 2019, 7 pages.

* cited by examiner

METHOD AND APPARATUS FOR FORMING A HELICAL TYPE FLIGHT

TECHNICAL FIELD

This disclosure relates generally to the manufacture of flights which are of a screw, helical or spiral shape. More particularly the disclosure is concerned with apparatus and a method of forming such flights. The flights so formed may find application in screw conveyors such as for example augers for conveying materials or liquids although the flights may be used for other purposes and applications.

BACKGROUND ART

Current methods of manufacturing conventional sectional screw flights utilize two basic techniques. The first technique employs a set of appropriately shaped dies to press segments of a flight blank so as to form a complete flight section of predetermined pitch. Each section of flight is then typically welded to a shaft in sequence to form a complete conveyor screw. An example of this technique is disclosed in patent specification WO 2013/003903. The second technique includes the use of two pairs of side plates. Each pair of side plates has a first fixed plate and a second movable plate, the second plate being movable relative to the fixed plate. The plates engage the flight blank so as to twist segments ranging from zero to 180 degrees. This method forms a flight to a predetermined pitch. An example of this technique is disclosed in U.S. Pat. No. 3,485,116.

SUMMARY OF THE DISCLOSURE

In a first aspect embodiments are disclosed of apparatus for use in the formation of a helical screw flight, the apparatus comprising: a drive, first and second support heads arranged for relative axial movement with respect to one another in a direction of a main axis in response to actuation of the drive, the first and second support heads being configured so as to be able to provide for a plurality of position adjustments including a lateral position adjustment whereby the first and second support heads can be displaced laterally with respect to the main axis in a direction of respective lateral axes and a rotational position adjustment wherein at least one of the first and second work heads can be rotated about a rotation axis which extends in a direction generally parallel or coaxial with the main axis.

In certain embodiments the first support head is operatively connected to the drive so as to be movable in the direction of the main axis in response to actuation of the drive and the second support head is operatively mounted so that axial movement in the direction of the main axis is inhibited. In certain embodiments the first and second support heads can be mounted for axial movement and may also be mounted so that one or both are rotatable.

In certain embodiments the drive comprises a linear actuator.

In certain embodiments the first support head comprises a main body mounted so as to be movable in the direction of its associated lateral axis. In certain embodiments the first support head comprises a holder operatively mounted to the main body so as to be movable in the direction of the lateral axis. In certain embodiments the second support head comprises a main body mounted so as to be movable in the direction of its associated lateral axis. In certain embodiments the first support head comprises a holder operatively mounted to the main body, the holder comprising a plurality of holder components mounted so as to be independently pivotable relative to one another about a pivot axis which extends generally parallel with its associated lateral axis.

In certain embodiments the second support head comprises a main body mounted so as to be movable in the direction of its associated lateral axis. In certain embodiments the second support head comprises a holder operatively connected to the main body, the holder comprising a plurality of holder components mounted so as to be independently pivotable relative to one another about a pivot axis which extends parallel to the lateral axis.

In certain embodiments the first support head comprises a holder operatively mounted to the main body of the first support head the holder comprising an elongated body having opposed ends, a slot extending from one end towards and terminating short of the other end, the slot comprising opposed V-shaped sides terminating at spaced part inner edges so as to provide for a gap or bight therebetween. In certain embodiments the second support head comprises a holder operatively mounted to the main body of the second support head the holder comprising an elongated body having opposed ends, a slot extending from one end towards and terminating short of the other end, the slot comprising opposed V-shaped sides terminating at spaced apart inner edges so as to provide for a gap or bight therebetween. The arrangement is such that it allows uniform rotation of the side edge of the blank so that interference occurs. This interference is minimal and permissible for most screw or helical flight segment formations. In certain embodiments the holder of the first and/or second support heads comprises a one piece component. In certain embodiments the apparatus comprises an arrangement for compensating a calculated spring back effect resulting from elasticity or resilience of the blank form which the helical screw flight is formed.

In certain embodiments the main body of the second support member is mounted for rotation about the rotation axis.

In certain embodiments the apparatus includes a main structure, the drive and first and second support members being operatively mounted to the main structure.

In certain embodiments the lateral movement of the first and second support heads in the direction of the lateral axes is free movement absent of a drive. In certain embodiments the rotation of one of the work heads about the rotation axis is free movement absent of a drive.

In certain embodiments the initial position of the first and second support heads in the direction of the lateral axes is mechanically or manually located and held in place prior to the first support member being drawn in the direction of the main axis.

In certain embodiments, the lateral movement of the first and second support heads in the direction of the lateral axes is driven movement effected by respective drives. In certain embodiments the rotation of one of the work heads about the rotation axis is driven movement effected by a further drive. In certain embodiments each driven movement is effected by a separate or different drive. In certain embodiments the drives are synchronised so as to produce the desired helical flight.

In certain embodiments the grippers or holders may be configured to compensate for blanks of different thicknesses. In this regard contact pins arranged to provide a force under pressure may be provided to secure the blank in position.

The apparatus enables the edge regions of the blank to move in accordance with the natural or true forming path of the flight helix. The natural or true forming path movement comprises movement generally at right angles to the helix axis, rotationally around the flight helix axis and rotationally about the axis which is at right angles to the flight helix axis.

As the first support member is drawn in the direction of axis X-X, the second support member corresponds to the natural forming rotation of the flight and rotates about axis M-M. The flight forms to the natural helix path. The first support member is extended to a predetermined length, which incorporates a calculated offset length due to the springback (elastic deformation) in the flight.

In certain embodiments, a similar technique can be employed by forming the flight to a predetermined length and then moving an additional calculated distance or coverage to compensate for the natural springback (elastic deformation) of the material. As this point the flight may be released and the springback accurately measured. The flight may be re-formed to include this updated springback (elastic deformation). This process may be repeated until the predetermined flight pitch is accurately achieved.

In certain embodiments the apparatus may be used to produce a canted helix. In this embodiment the first and second support heads are mounted so that they can be laterally adjusted in the direction of lateral axes. These position adjustments are driven adjustments; (that is a suitable drive can be used to cause the position adjustments.) The first and second support heads are laterally adjusted so that the central axis inclines angularly to main axis during forming. The formed helix has side edges that are of a pre-determined angle to the central axis.

Other aspects, features, and advantages will become apparent from the following detailed description when taken in conjunction with the accompanying drawings, which are a part of this disclosure and which illustrate, by way of example, principles of inventions disclosed.

DESCRIPTION OF THE FIGURES

The accompanying drawings facilitate an understanding of the various embodiments.

DETAILED DESCRIPTION

Figure 1:
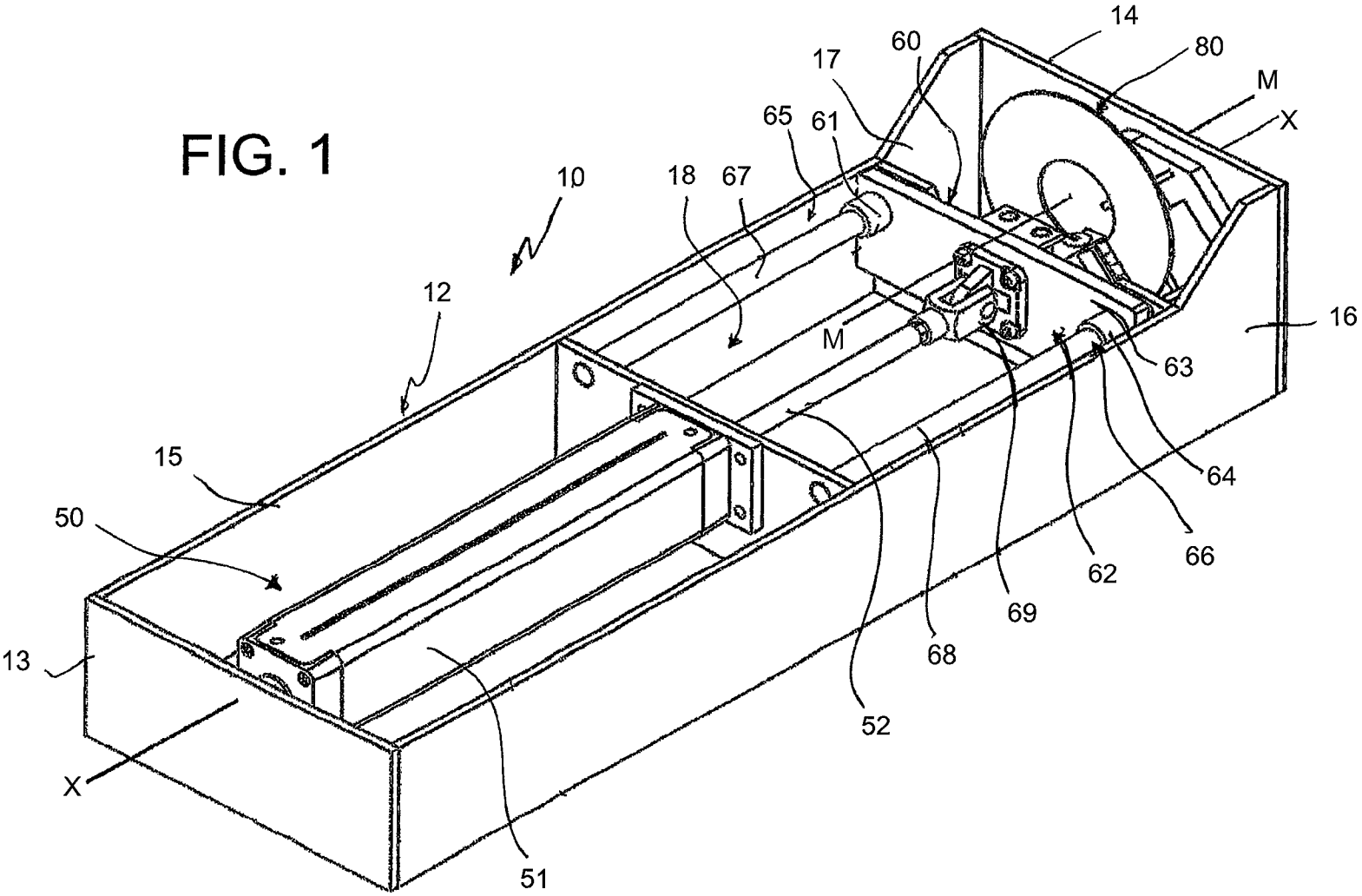
FIG. 1 is an isometric view of apparatus according to a first embodiment in an initial stage.

Referring in particular to FIGS. 1 to 11 of the drawings there is illustrated a first embodiment of apparatus or machine 10 for use in the formation of a flight of spiral, helical or screw shaped configuration. As shown in detail in FIGS. 10 and 11 the flight is formed from a blank 80 which is a generally annular body 81 in the form of a generally circular disc-like member having an outer peripheral edge 82, an inner or central hole 83 having an inner peripheral edge 84 with a split from the outer to the inner edges 82 to 84 thereby providing for opposed side edges 85 and 86. In the embodiment shown the blank 80 is generally circular with an inner circular hole, the outer peripheral edge and the inner peripheral edge being circumferential edges. In other embodiments the blank need not be circular. The blank may be formed from any suitable material such as for example metals including steel, aluminium and may have some resilience or elastic deformation properties. A central axis A-A extends through the centre of the hole 83. The side edges 85 and 86 extend radially with respect to axis A-A. As such the side edges are slightly inclined with respect to one another.

The apparatus 10 includes a main structure, frame, or housing 12 which in the form shown comprises end walls 13 and 14 and side walls 15 and 16 which are operatively secured together to form a rigid structure. The structure or housing 12 has a compartment 18 therein, one end region of which forms a flight forming zone 17.

The compartment 18 further accommodates a drive 50 the purpose of which will become hereinafter apparent. The drive 50 in the form shown comprises a linear actuator 51 which facilitates motion in a straight line in the direction of main axis X-X. The linear actuator may be in the form of a screw and nut assembly, ball nut and screw assembly, hydraulic or pneumatic piston/cylinder, piezo electric, or electro mechanical arrangement. A connecting rod 52 operatively connects the drive 50 to a component of the apparatus.

The apparatus 10 further includes first and second support heads 20 and 30 (clearly illustrated in FIGS. 2, 6 and 7 for example) which in use are adapted to hold the blank 80 in the region of the side edges 85 and 86; that is support head 20 is configured so as to hold the blank 80 in a side edge region of side edge 85 and support head 30 is configured so as to hold the blank 80 in a side edge region of side edge 86. The side edge region as used herein does not necessarily mean at the side edge but includes a region spaced from the side edge. The first supporting head 20 is an axially displaceable head arranged for displacement or movement in the direction of the main axis X-X in response to actuation of the drive. The second support head 30 is mounted to end wall 14 so as to be inhibited from movement in the direction of the main axis X-X.

As shown in FIG. 1 the first support head 20 is operatively connected to the drive 50 through a mounting 60 which includes a mounting member 62 which comprises a mounting plate 63. The plate 63 is operatively connected to connecting rod 52 via coupling 69. The plate 63 is carried on guides 65 and 66 which in the form shown comprise guide rods 67 and 68 and associated sleeves 61 and 64. The structure of the first support head 20 is clearly illustrated in FIGS. 5, 6 and 7 and FIGS. 22 to 26 for example.

Figure 6:
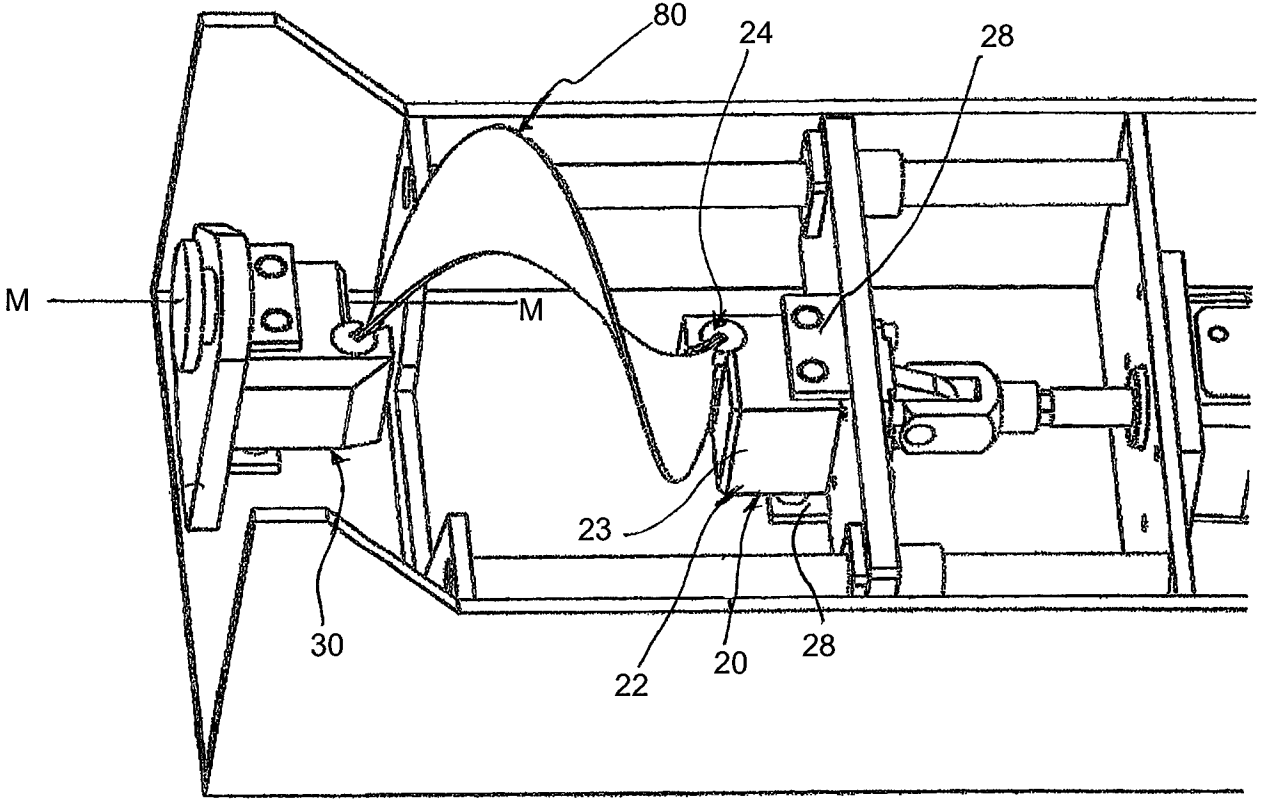
FIG. 6 is a similar view to that of FIG. 5 at the stage shown in FIG. 2.
Figure 22:
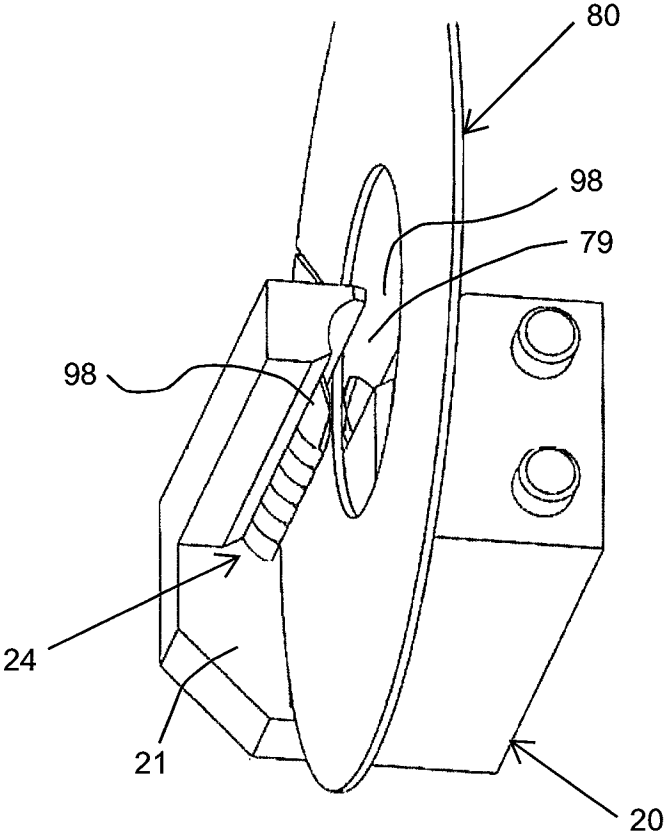
Figure 25:
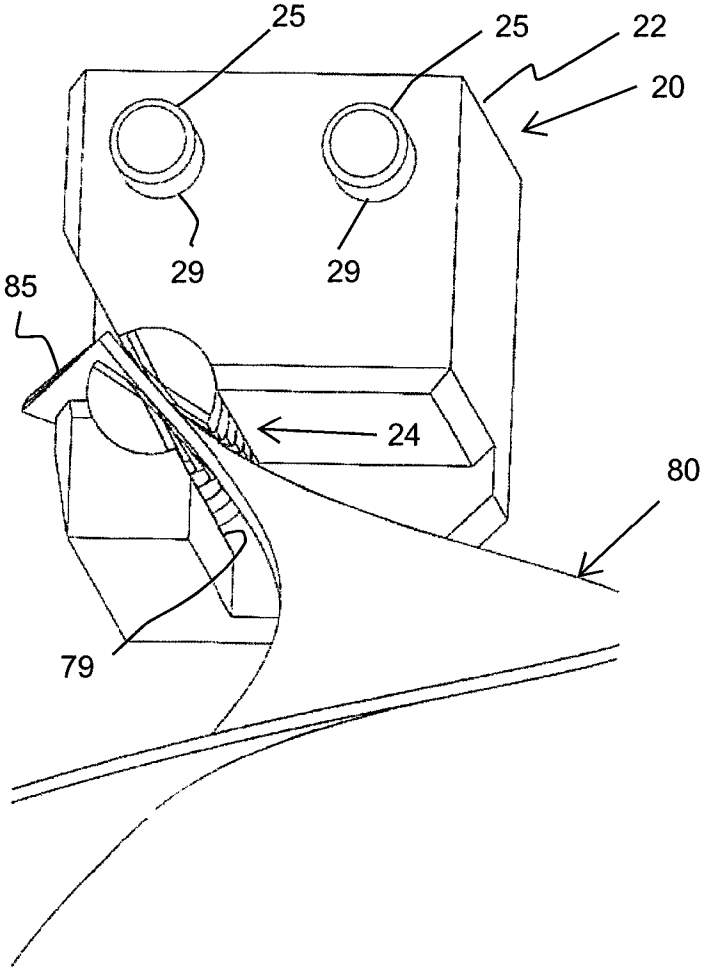
FIGS. 24 and 25 are isometric views of parts of the apparatus in various stages of operation according to another embodiment.
Figure 24:
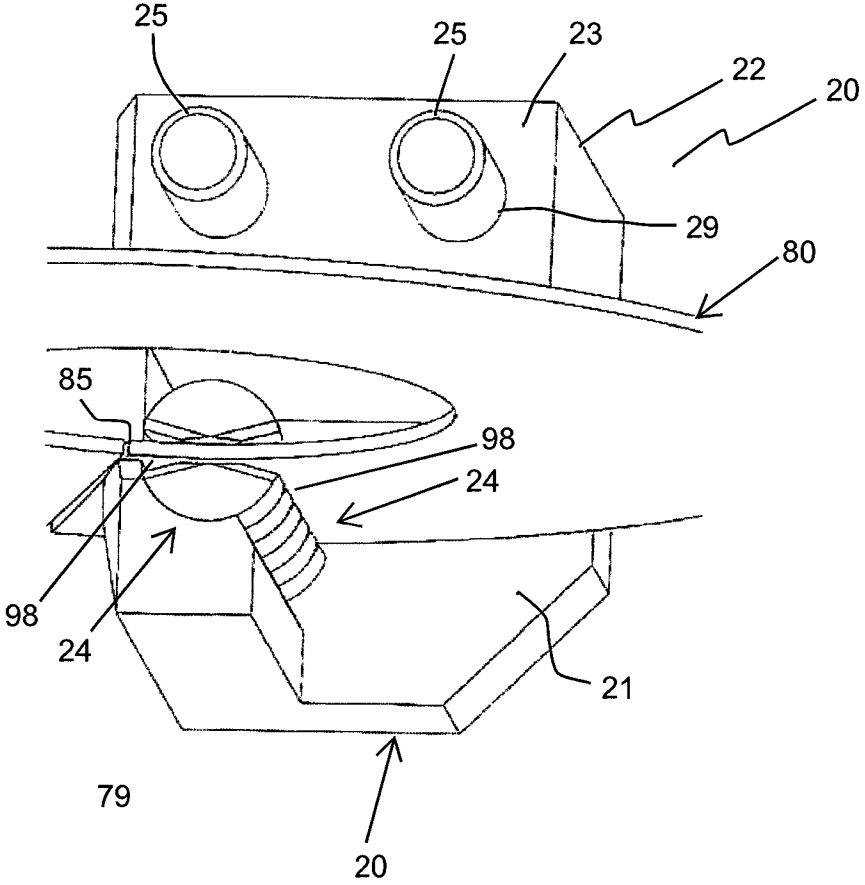

With reference to FIGS. 6 and 22 the first support head 20 comprises a body portion 22 in the form of block like member 23 which is operatively mounted to mounting plate 63. The first support head 20 further includes a blank gripper or holder 24 which is adapted to grip or hold the blank 80 in the region of side edge 85. Details of various types of holders will be described hereinafter. As shown in FIG. 22 for example the body portion 22 includes a ledge 21 against which the blank can seat in an initial or pre-formed position (the ledge 21 is not shown in every drawing). The ledge can be fixed or adjustable. Ledge adjustment can be mechanically driven or manual.

The first support head is arranged so that a lateral displacement of at least part thereof can be effected in a lateral direction with respect to main axis X-X. The lateral displacement is generally in the direction of lateral axis W-W (see FIGS. 8 and 9). The lateral displacement can be effected in different ways. For example, as shown the body portion 22 can be mounted for lateral displacement. To this end the body portion 22 can be mounted on guides in the form shown comprises guide rods 25 secured to mounting plates 28 which are secured to mounting plate 63 (see for example FIGS. 6, 7, 24 and 25). The rods 25 extend through apertures 29 in the body portion 22 so that the body portion 22 can track along the rods 25 in the direction of axis W-W. In another arrangement the blank holder 24 may be mounted to the body portion 22 so as to be displaceable in the direction of the lateral axis. In another arrangement the lateral displacement could be a combination of the displacement of the body portion 22 and the blank holder 24.

Figure 30:
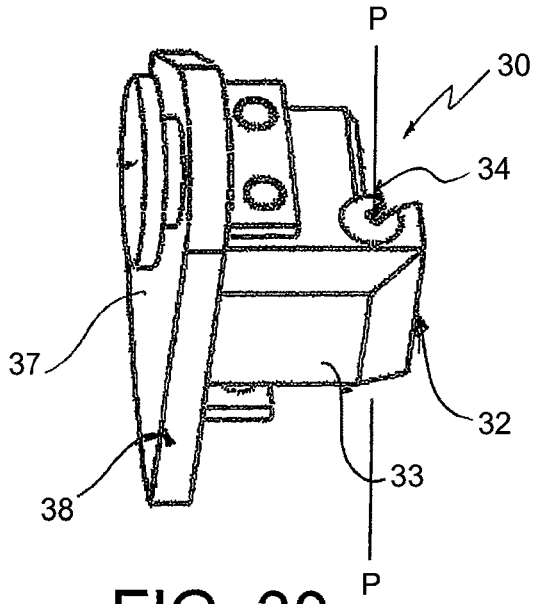
FIGS. 30 to 32 are various views of a component of the apparatus.
Figure 31:
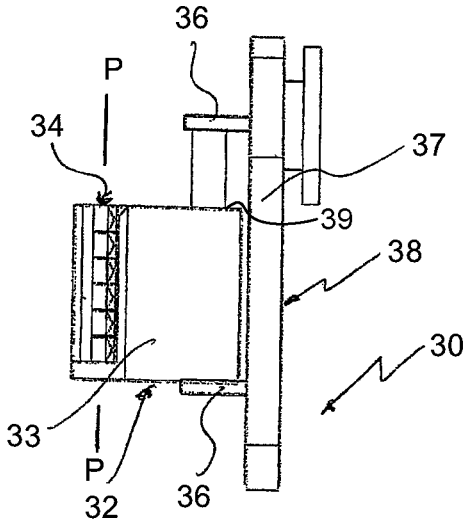
Figure 32:
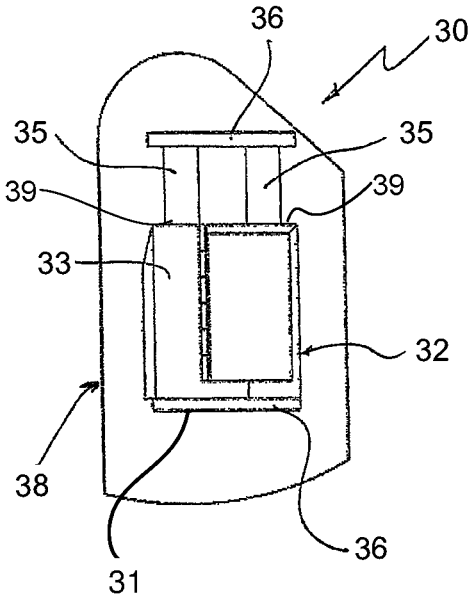

The second support head 30 is similar in form to the first support head 20 and is described in detail in FIGS. 30 to 32. It comprises a body portion 32 in the form of a block like member 33 which is operatively mounted to end wall 14 of the main structure or housing 12. The body portion 32 is operatively connected to a support 38 which is mounted to the end wall 14 for rotation about an axis M-M which is parallel or co-axial with the main axis X-X. The support 38 is in the form of a plate member 37. The body portion 32 has a ledge similar to ledge 21 of the first support head 20 against which the blank 80 can seat. The second support head 30 also includes a blank gripper or holder 34 which is adapted to grip or hold the blank 80 in the region of side edge 86.

Figure 8:
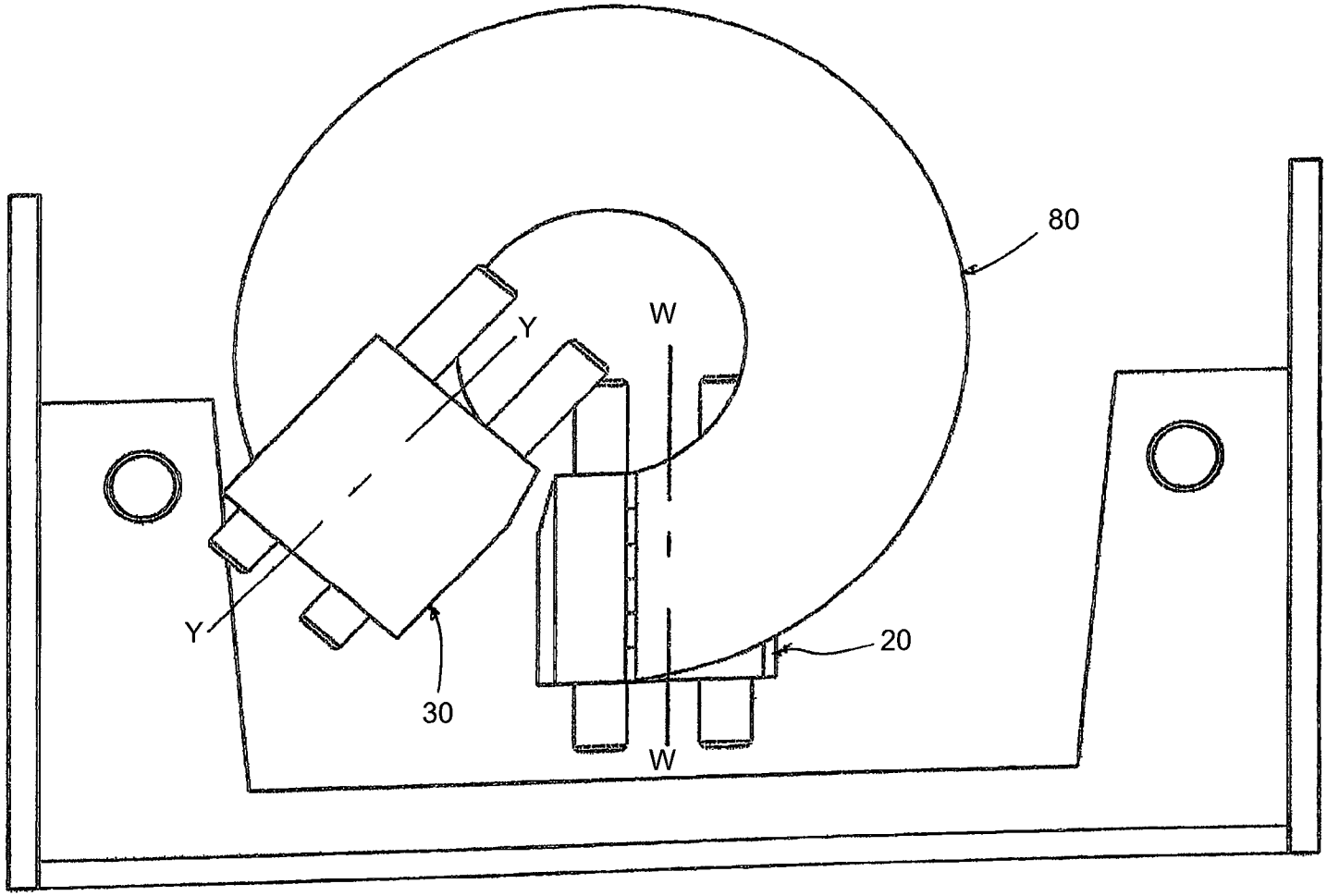
FIG. 8 is an end view of the apparatus shown in FIGS. 1 to 7 in the stage of FIGS. 1, 4 and 5.
Figure 9:
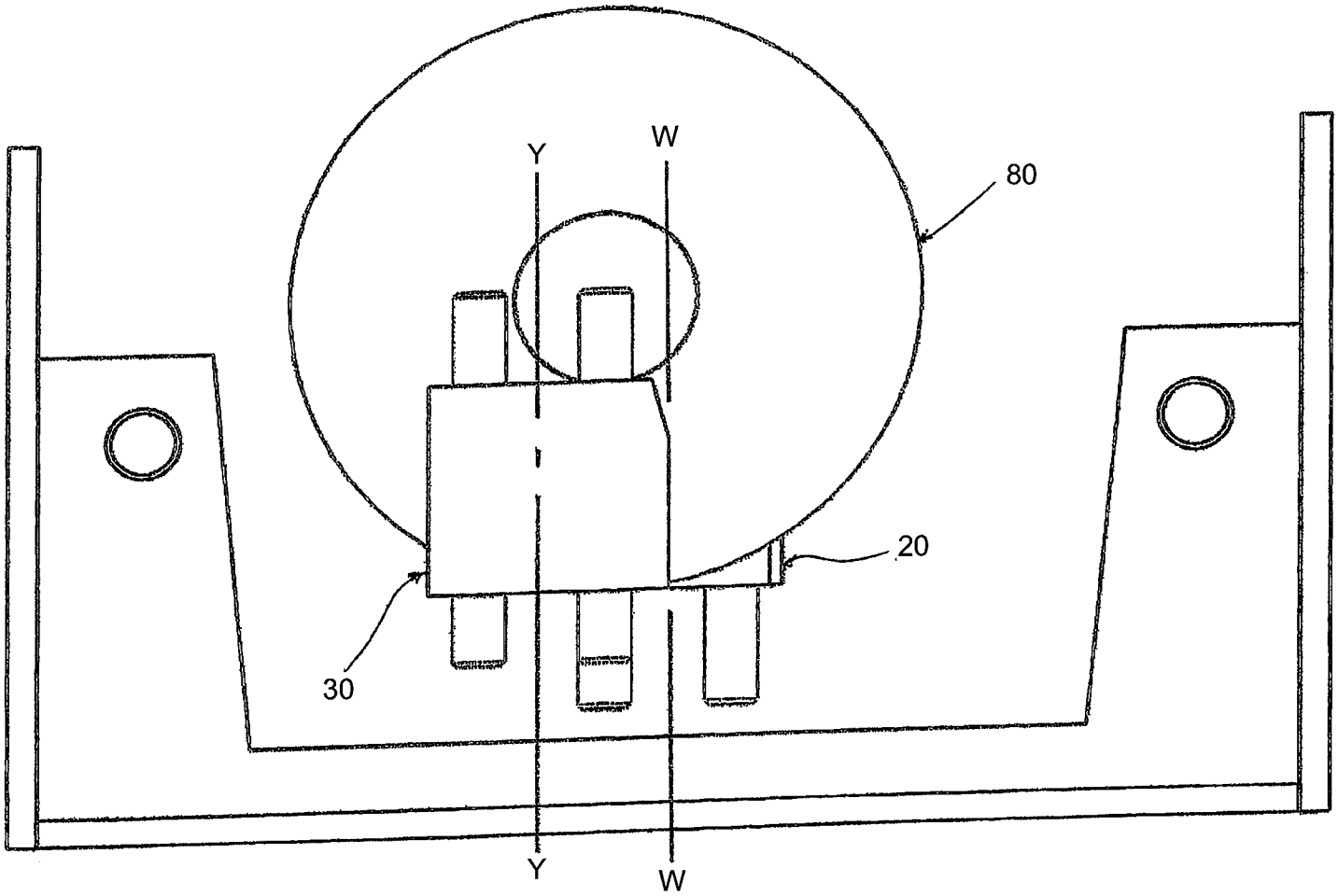
FIG. 9 is an end view in the stage of FIGS. 2 and 6.

In a similar fashion to the first support head the second support head is arranged so that a lateral displacement of at least part thereof can be effected. The lateral displacement is generally in the direction of axis Y-Y (FIGS. 8 and 9). Because the body portion 32 can rotate about axis M-M it will be appreciated that the angular position of lateral axis Y-Y will change. The lateral displacement can be effected in different ways. For example, as shown the body portion 32 can be mounted for lateral displacement. To this end the body portion 32 can be mounted on guides in the form of guide rods 35 secured to mounting plates 36 which are secured to support plate 38. The rods 35 extend through apertures 39 (FIG. 31) in the body portion 32 so that the body portion can track along the rods 35. In another arrangement the blank holder 34 may be mounted to the body portion 32 so as to be displaceable in the direction of the lateral axis. In another arrangement the lateral displacement could be a combination of the displacement of the body portion 32 and the blank holder 34.

The holders 24 and 34 for each of the support heads may take several forms. One form is illustrated in FIGS. 12 to 15. Another form is illustrated in FIGS. 16 to 18 and yet another form is illustrated in FIGS. 19 to 22.

Figure 14:
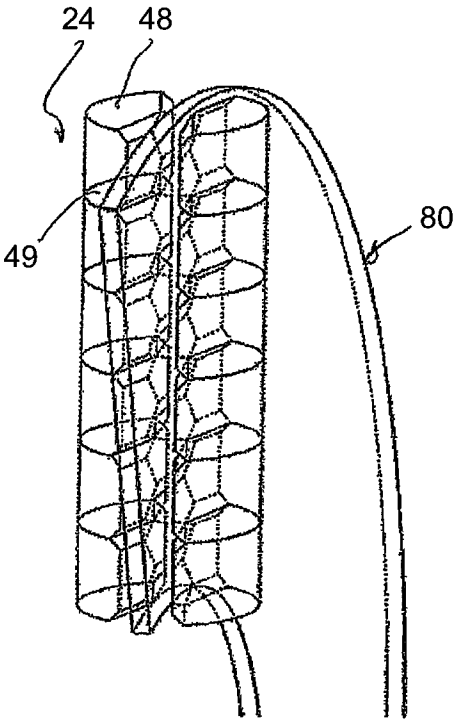
FIGS. 12 to 15 are various illustrations of a component of the apparatus according to one embodiment.
Figure 13:
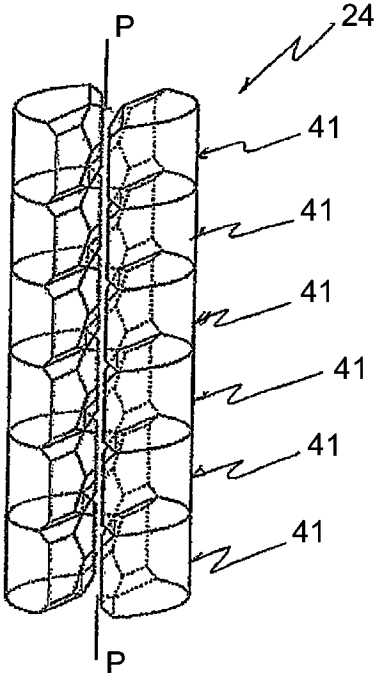
Figure 12:
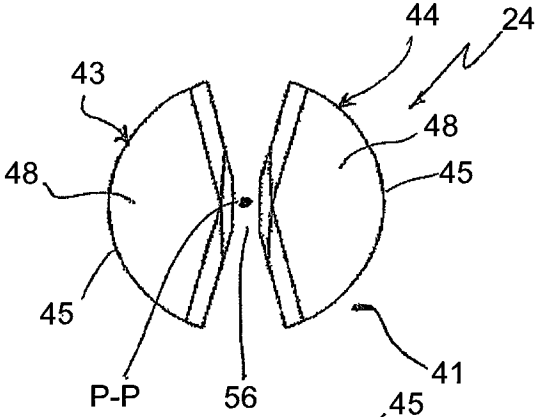
Figure 15:
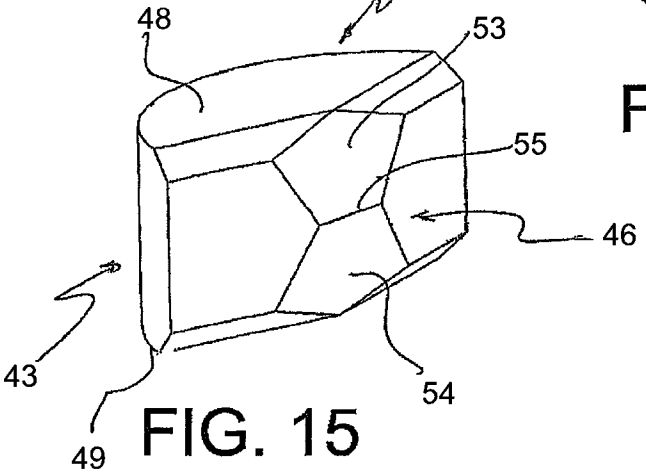

FIGS. 12 to 15 illustrate a holder 24 for the first support head 20. The holder 34 for the second support head can be of the same construction. This is the case for each of the embodiments of holder described. The holder 24 comprises a plurality of holder components 41 arranged side by side as shown in FIGS. 13 and 14. Each of the holder components 41 is at least partially rotatable about pivot axis P-P independently of one another. Each of the holder components 41 comprises two cooperating holder elements 43 and 44. As best seen in FIGS. 15 and 16 the holder elements 43 and 44 comprise an outer curved side wall 45, an inner side wall 46 and flat or planar end walls 48 and 49. The inner side wall 46 includes two inclined sections 53 and 54 extending outwardly from the end walls 48 and 49 and towards one another terminating at an edge 55. As best seen in FIG. 12 the edges 55 of the holder elements 43 and 44 face one another providing for a gap or bight 56 therebetween. As illustrated in FIG. 14 the side edge region of the blank passes through the bight 56 so that the holder components hold or grip the blank.

Figure 18:
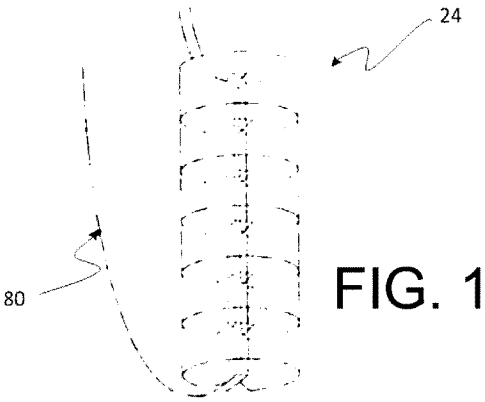
FIGS. 16 to 18 are various illustrations of a component of the apparatus according to another embodiment.
Figure 17:
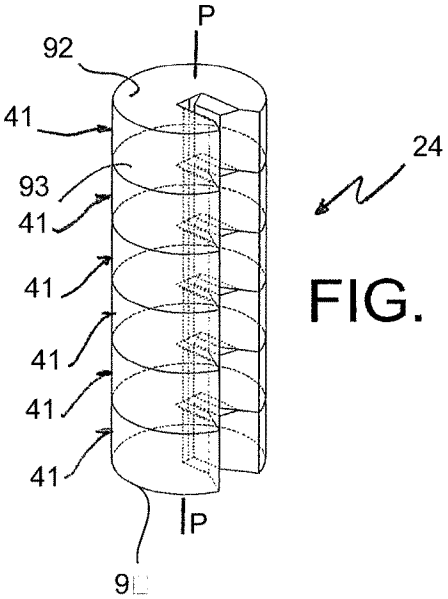
Figure 16:
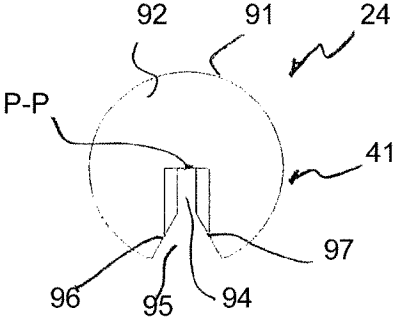

FIGS. 16 to 18 illustrate another form of holder 24. In this embodiment the holder 24 comprises a plurality of holder components 41 arranged side by side as shown in FIGS. 17 and 18. Each of the components 41 is at least partially rotatable about pivot axis P-P independently of one another. In this embodiment each component 41 comprises a disc like member comprising a curved outer wall 91 and end walls 92 and 93. A slot 94 is provided in the side wall the end of the slot terminating at axis P-P. The slot 94 includes a mouth 95 having outwardly inclined sides 96 and 97. As shown in FIG. 18 the edge section of the blank is received within the slot 94.

Figure 21:
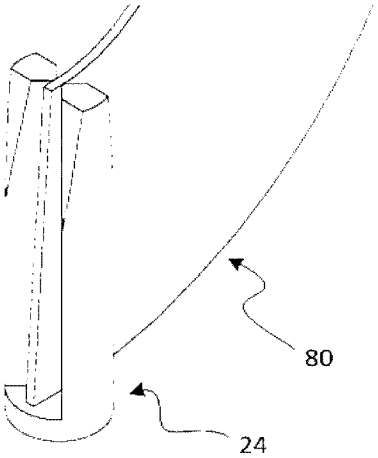
FIGS. 19 to 21 are various illustrations of a component of the apparatus according to another embodiment.
Figure 20:
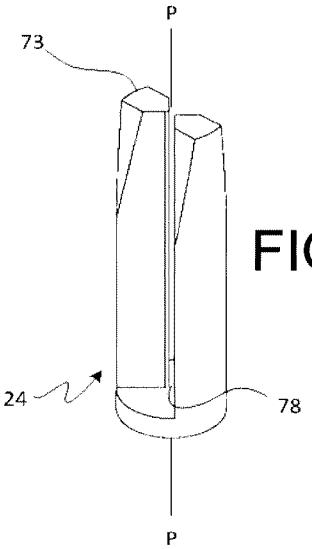
Figure 19:
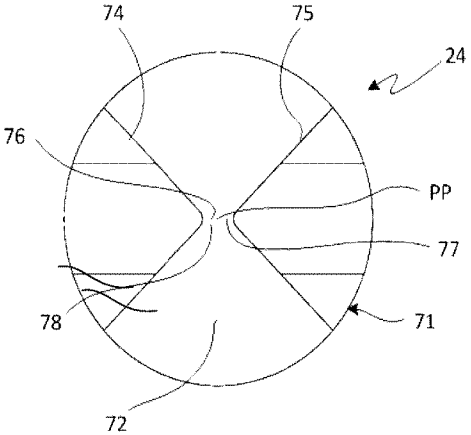
Figure 23:
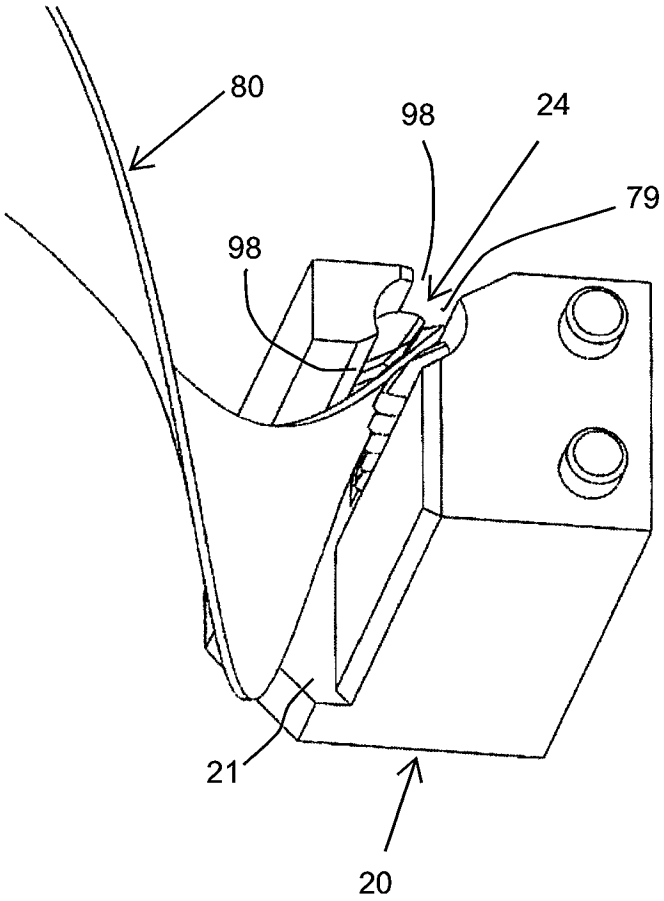
FIGS. 22 and 23 are isometric views of parts of the apparatus in various stages of operation according to one embodiment.

FIGS. 19 to 21 illustrate yet another form of holder 24. In this embodiment the holder comprises a main body 71 which is circular in plan and has a slot 72 extending therethrough. The slot 72 extends from one end 73 terminating short of the other end. The slot 72 includes opposed V-shaped sides 74 and 75 terminating at edges 76 and 77 arranged to provide for a gap or bight 78 therebetween. As shown in FIG. 21 the edge section of the blank extends through the slot and is held in the bight 78. The arrangement is such that it allows uniform rotation of the side edge of the blank so that interference occurs. This interference is minimal and permissible for most screw or helical flight segment formations.

At best seen in FIGS. 22 to 29 the components 41 are disposed within a housing cavity 79 in the support heads.

The housing cavity 79 which may be in the form of a socket is configured to permit at least partial rotation of the holder 24 therein. The cavity 79 may include a curved inner wall which is complementary to the curved side wall of the support 24 thereby enabling relative rotation therebetween. One or more access slots 98 may be provided to enable the side edge region of the blank to engage with holder 24 (FIGS. 22 to 29).

Figure 4:
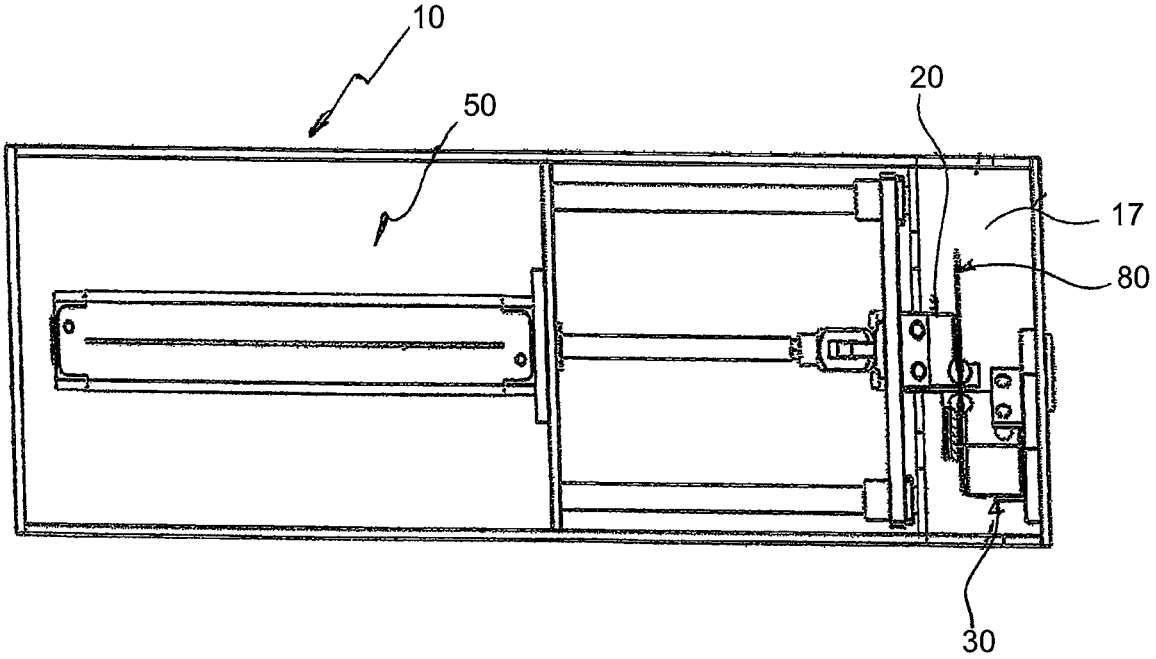
FIG. 4 is a top plan view of the apparatus shown in FIG. 1.
Figure 5:
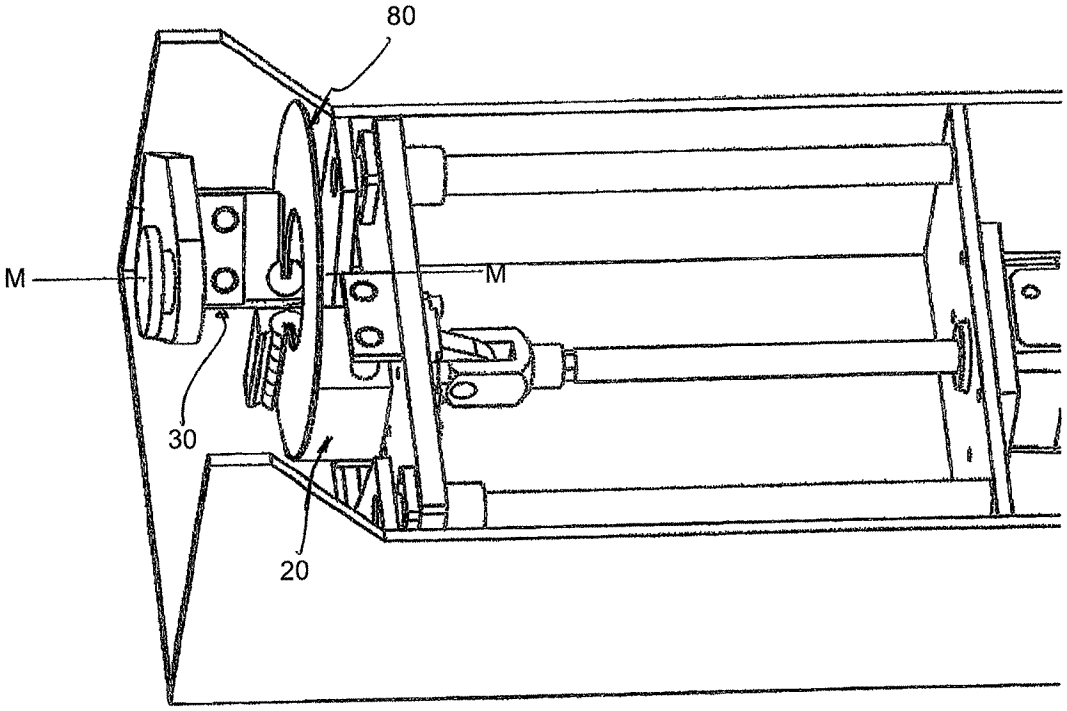
FIG. 5 is a more detailed view of the apparatus shown in FIGS. 1 to 4 in the stage illustrated in FIGS. 1 and 4.

The operation of the apparatus will hereinafter be described. With the apparatus in the initial or preforming position as shown in FIGS. 1, 4 and 5 the blank 80 is installed so as to be ready for formation into a helical type flight. As clearly illustrated in FIGS. 5 and 8 for example the first and second support heads 20 and 30 are disposed at least partially side by side with the second support head 30 being angularly inclined with respect to the first support head 20. In this position the side edges 85 and 86 are positioned within respective holders 24 and 34 with the outer circumferential edge 82 seated on the ledges of the first and second support heads 20 and 30. The ledge for the second support head is not illustrated in FIGS. 30 to 32 but can be same as ledge 21 for the first support head. In this position the blank 80 is in a plane which is at right angles to the main axis X-X. Furthermore the central axis A-A of the blank is co-axial with the rotation axis M-M of the support head 30. The position of the seating ledges 21 and 31 can be adjusted for different sized blanks.

Figure 2:
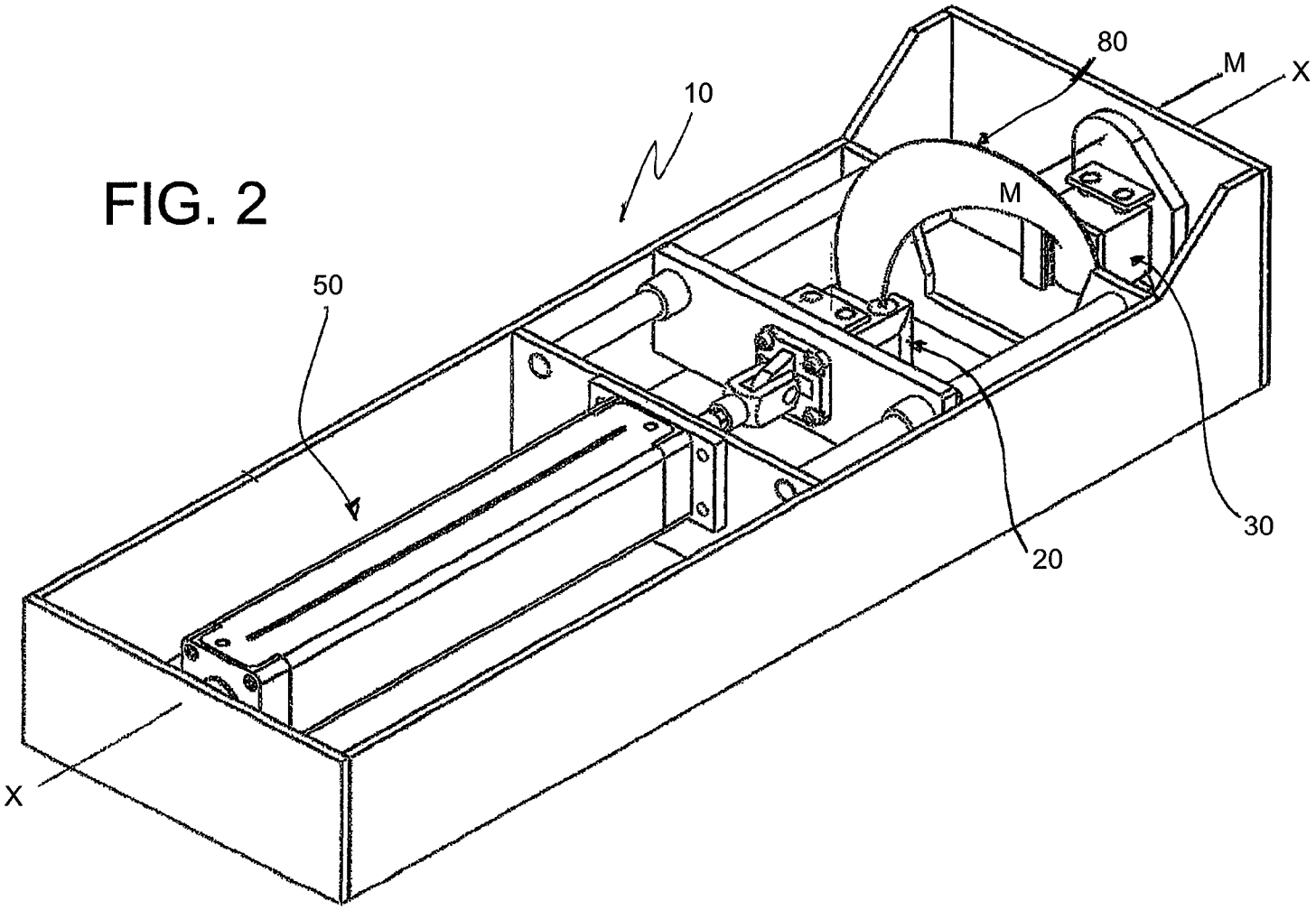
FIG. 2 is an isometric view of the apparatus shown in FIG. 1 illustrating a further stage in the forming procedure.

The drive 50 is then actuated so that the side edges 85 and 86 are drawn or pulled apart the drive motion being in the direction of the main axis X-X. During this forming movement the blank automatically adopts the natural or true helical profile. In order to try and ensure that this natural helical profile is maintained as closely as possible the first and second support heads 20 and 30 are mounted so that they can be laterally adjusted in the direction of the lateral axes W-W and Y-Y and further the position of the second support head 30 can be rotationally adjusted above axis M-M. This is clearly illustrated in FIGS. 2, 6 and 9 for example these position adjustments can be free adjustments (that is the support heads can move freely as the helical profile is formed) or can be driven adjustments; (that is a suitable drive can be used to cause the position adjustments.) The formed position is shown in FIGS. 2 and 6. The second embodiment as shown in FIGS. 39 to 49 illustrates an arrangement where the adjustments are driven.

Figure 27:
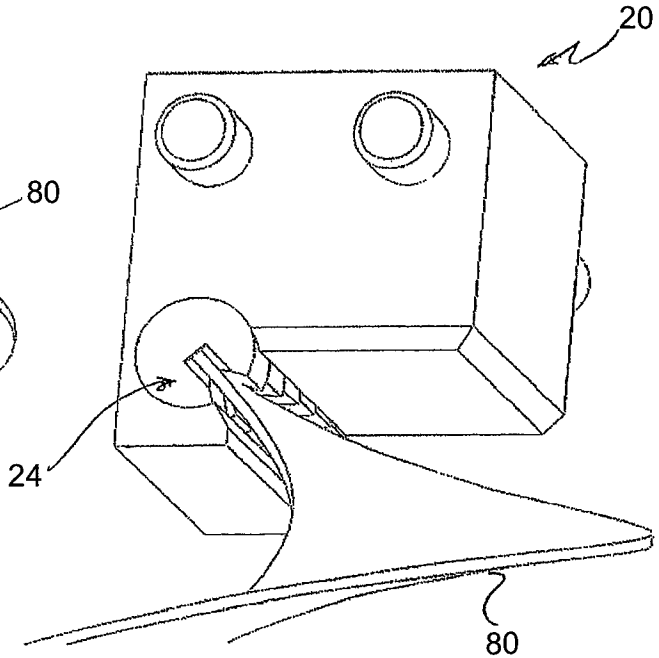
FIGS. 26 and 27 are isometric views of the apparatus according to another embodiment.
Figure 26:
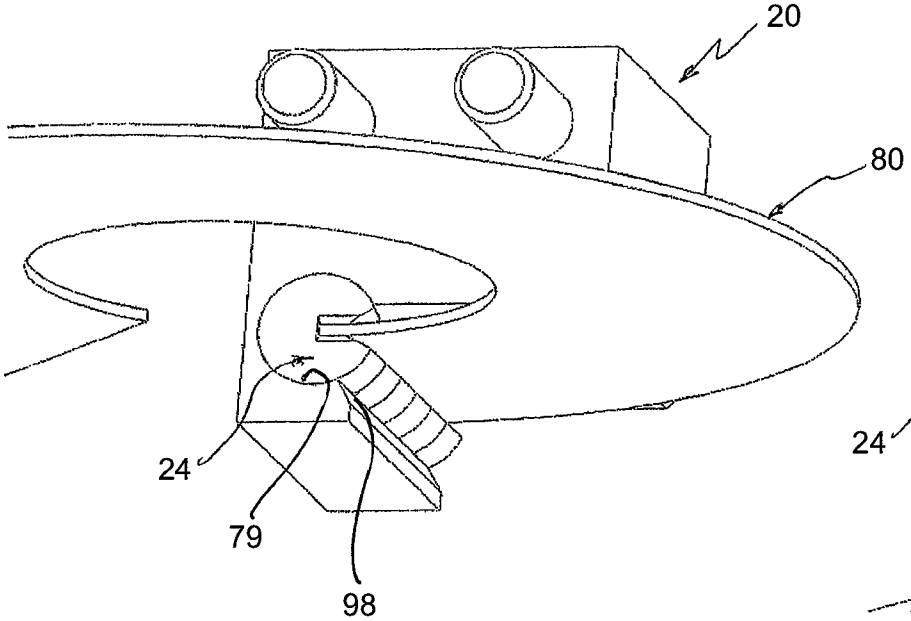
Figure 29:
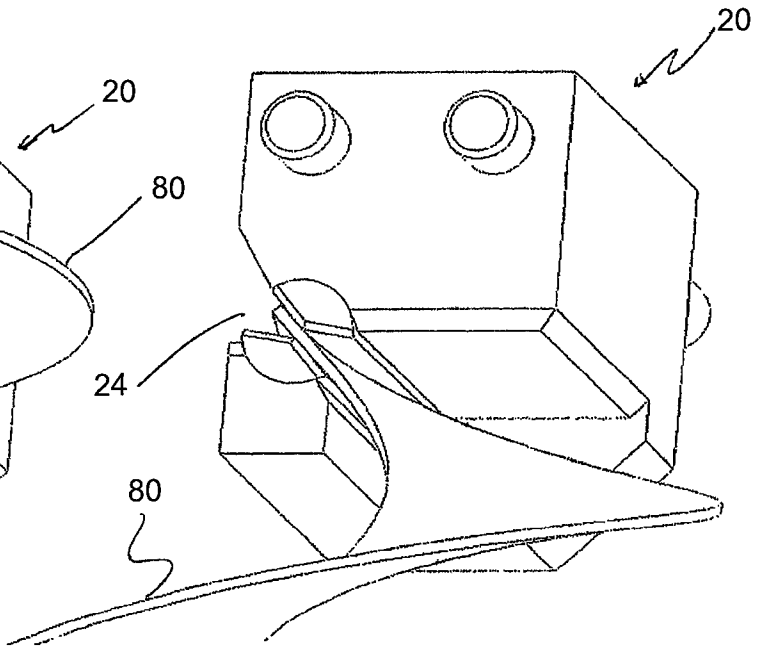
FIGS. 28 and 29 are isometric views of the apparatus according to another embodiment.
Figure 28:
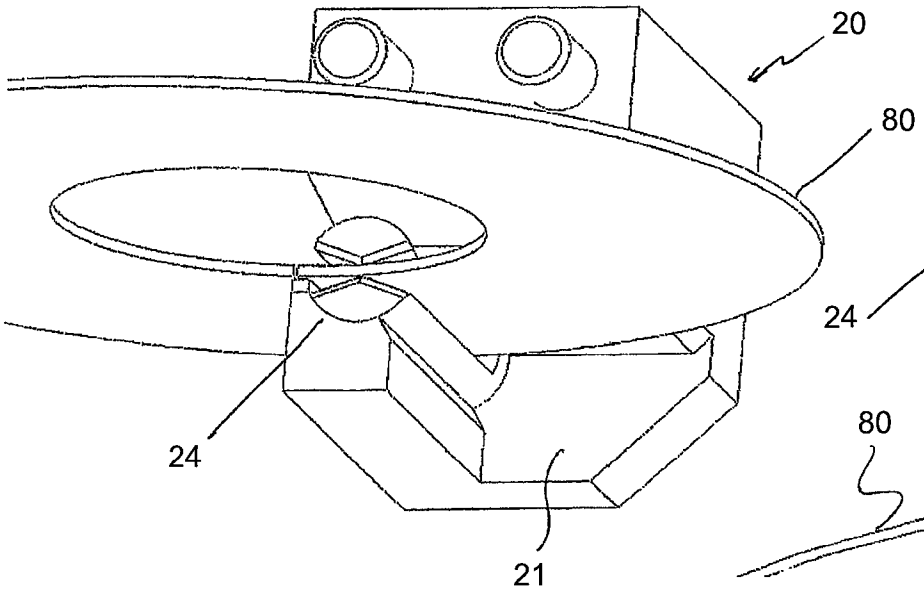

The movement of the holders shown in FIGS. 12 to 15 is illustrated in FIGS. 22 to 25. During the helical formation step each of the holder components can partially rotate about pivot axis P-P (see FIGS. 12 to 15) independently of one another. This can be seen in FIGS. 23 and 25. The holders illustrated in FIGS. 16 to 18 function in a similar fashion and this is shown in FIG. 27. The holder shown in FIGS. 19 to 21 is a one piece component and due to its construction enables the helical formation as shown in FIG. 29.

Figure 3:
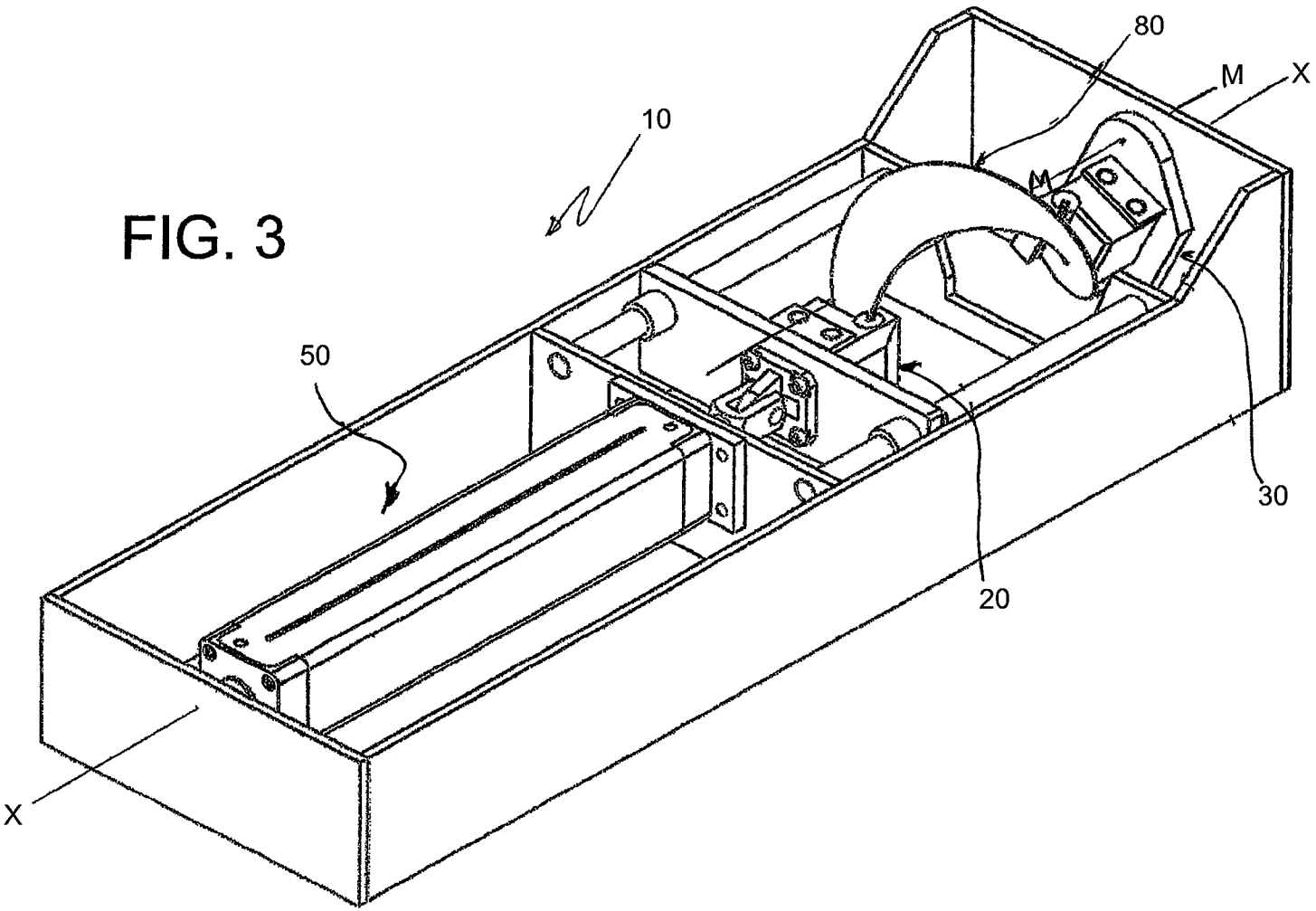
FIG. 3 is an isometric view of the apparatus shown in FIG. 1 illustrating a further stage in the procedure.
Figure 7:
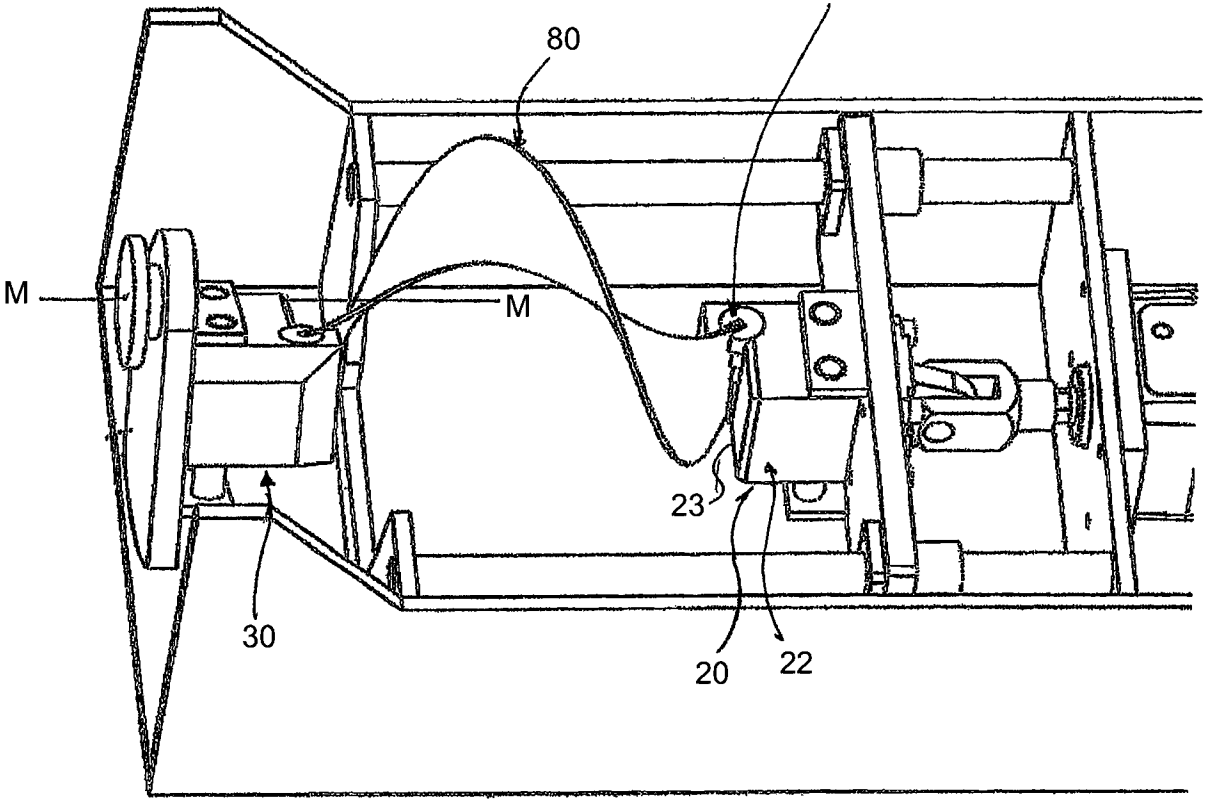
FIG. 7 is a similar view to that of FIG. 6 at the stage shown in FIG. 3.

During formation of the flight the blank is drawn or pulled in the direction of the axis X-X beyond the point at which the required helix profile is achieved. This is shown in FIGS. 3 and 7. This can take into account spring back which is a result of elastic deformation properties of the material from which the flight is being formed. When the pulling motion of the drive ceases the arrangement can be such that the profile is caused to spring back to the desired helix profile by disconnection of the support head 20 from its associated drive.

Figure 54:
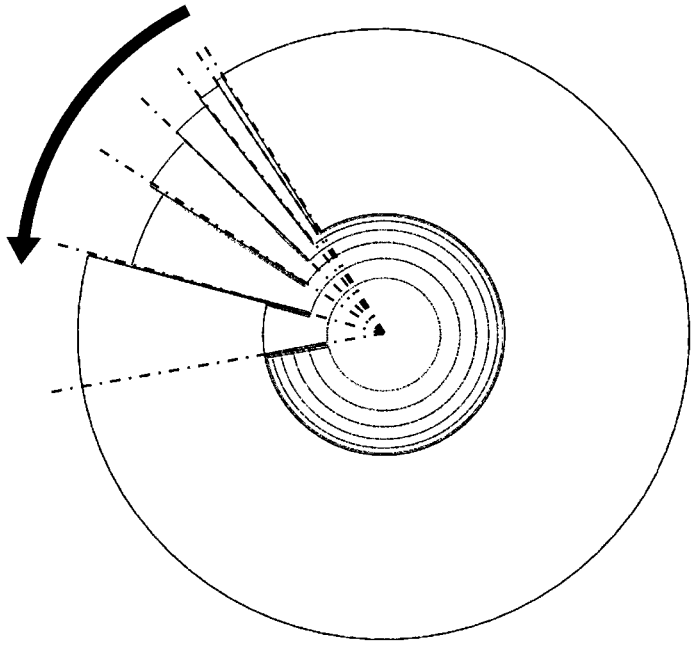
Figure 53:
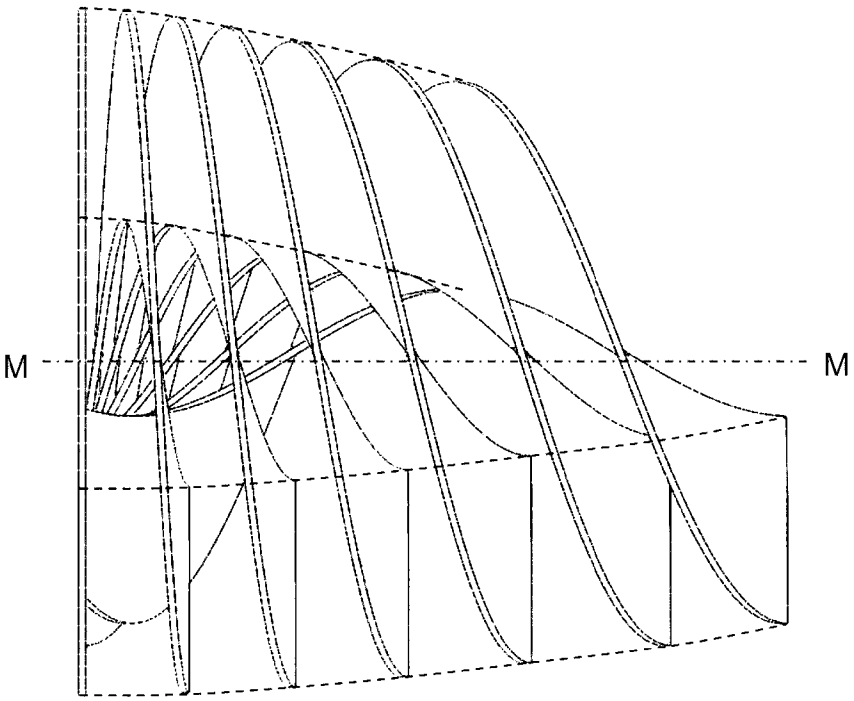

During the formation step the outer diameter or cross-sectional area of the blank at its outer periphery and the cross-sectional area or diameter of the central hole are reduced to the final desired dimensions. This is illustrated in FIGS. 53 and 54.

Figure 33:
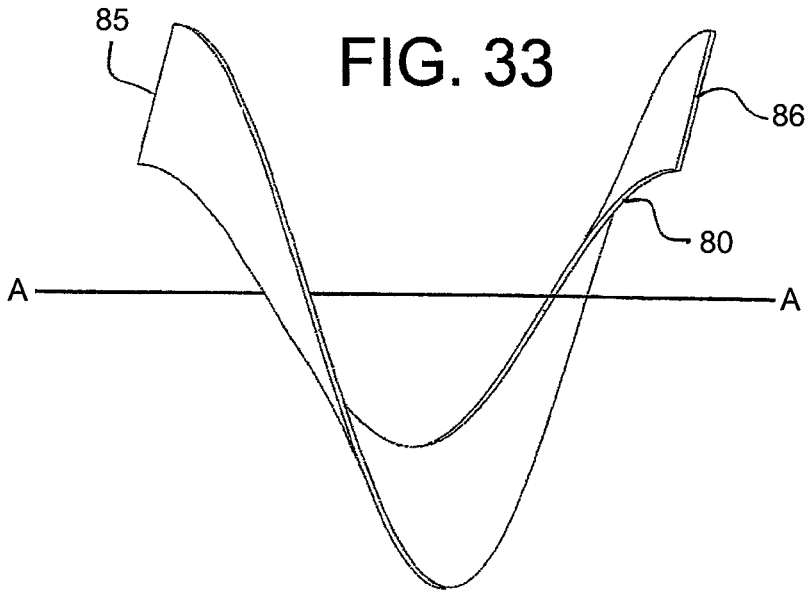
FIGS. 33 to 36 are various views of apparatus for forming a canted helix.
Figure 34:
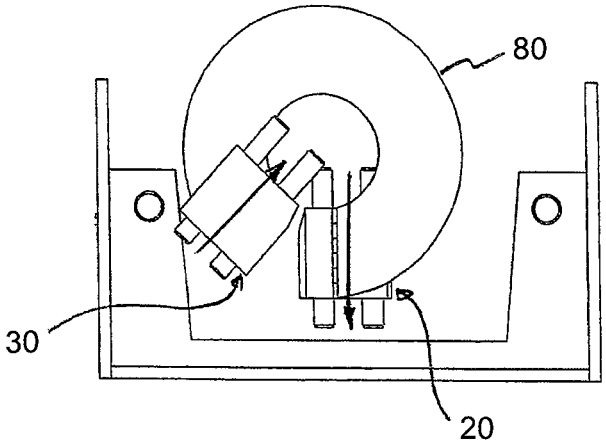
Figure 35:
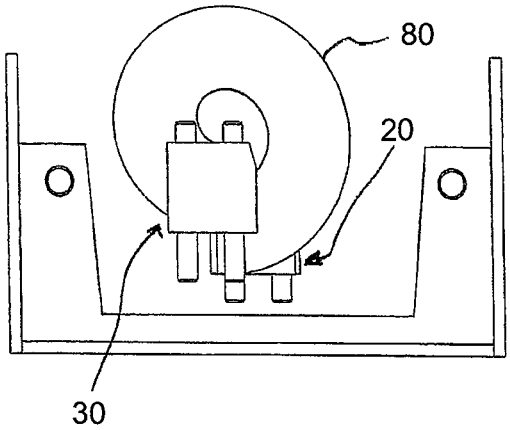
Figure 36:
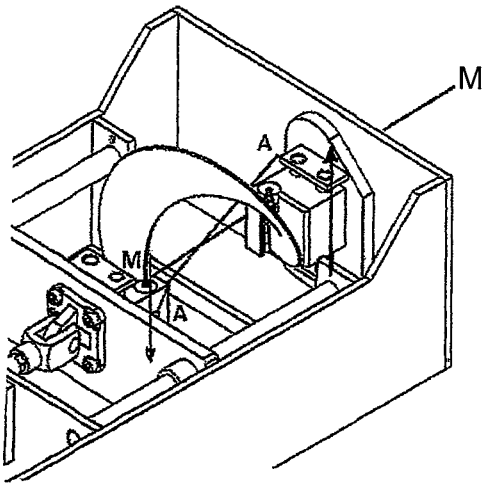

FIGS. 33 to 36 illustrate how the apparatus can be used to form a canted helix. A canted movement is required to produce a canted helix. As shown the first and second support heads 20 and 30 are mounted so that they can be laterally adjusted in the direction of the lateral axes W-W and Y-Y as shown by arrows in FIGS. 34 and 36. These position adjustments are driven adjustments; (that is a suitable drive can be used to cause the position adjustments). The preformed and formed positions are shown in FIGS. 34 and 35. The first and second support heads 20 and 30 are laterally adjusted so that the central axis A-A inclines angularly to main axis X-X during forming. As shown in FIG. 33 the formed helix has side edges 85 and 86 that are of a pre-determined angle to the central axis A-A. FIG. 36 illustrates the inclination of axis A-A with respect to axis X-X after formation.

Figure 37:
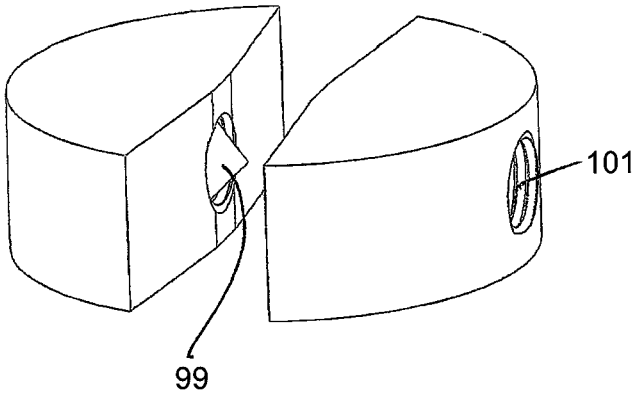
FIGS. 37 and 38 are isometric and sectional views of apparatus according to certain embodiments.
Figure 38:
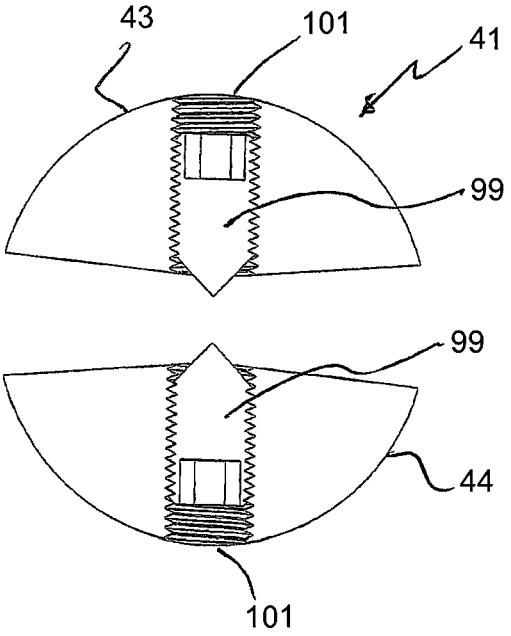
Figure 39:
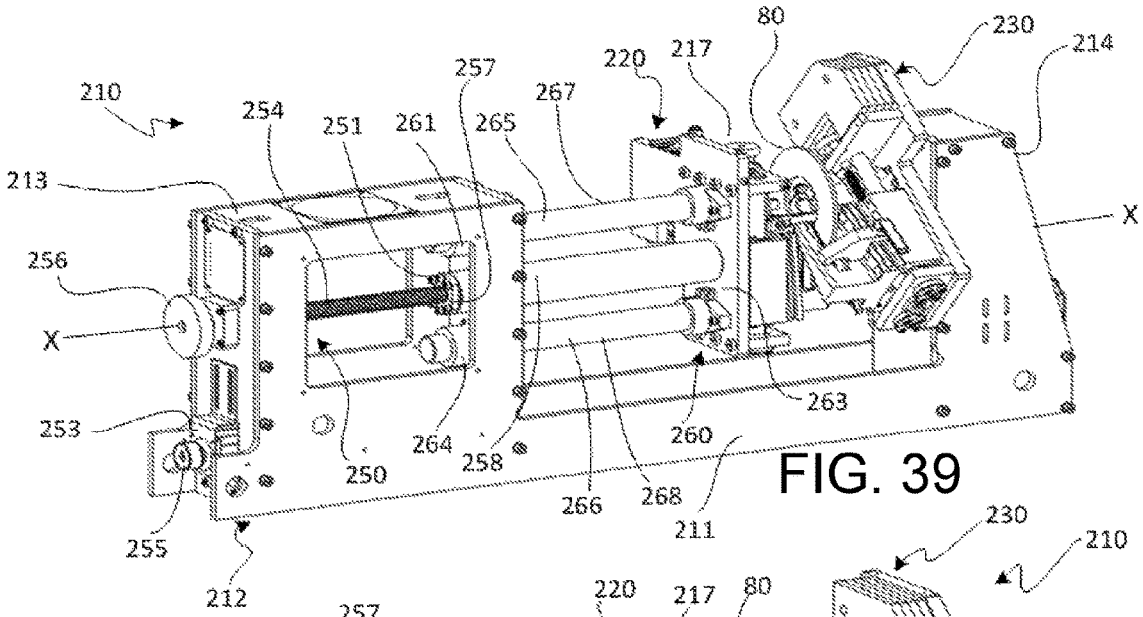
FIGS. 39 to 41 are schematic isometric views from one end of apparatus according to a second embodiment in different positions.
Figure 40:
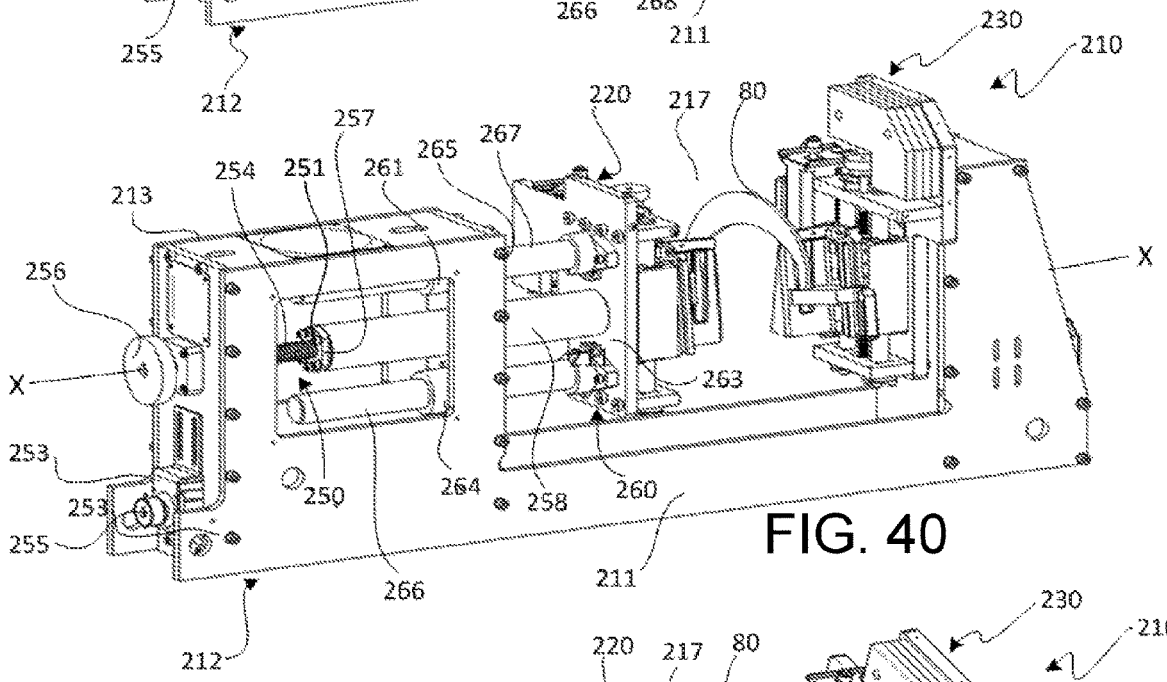
Figure 41:
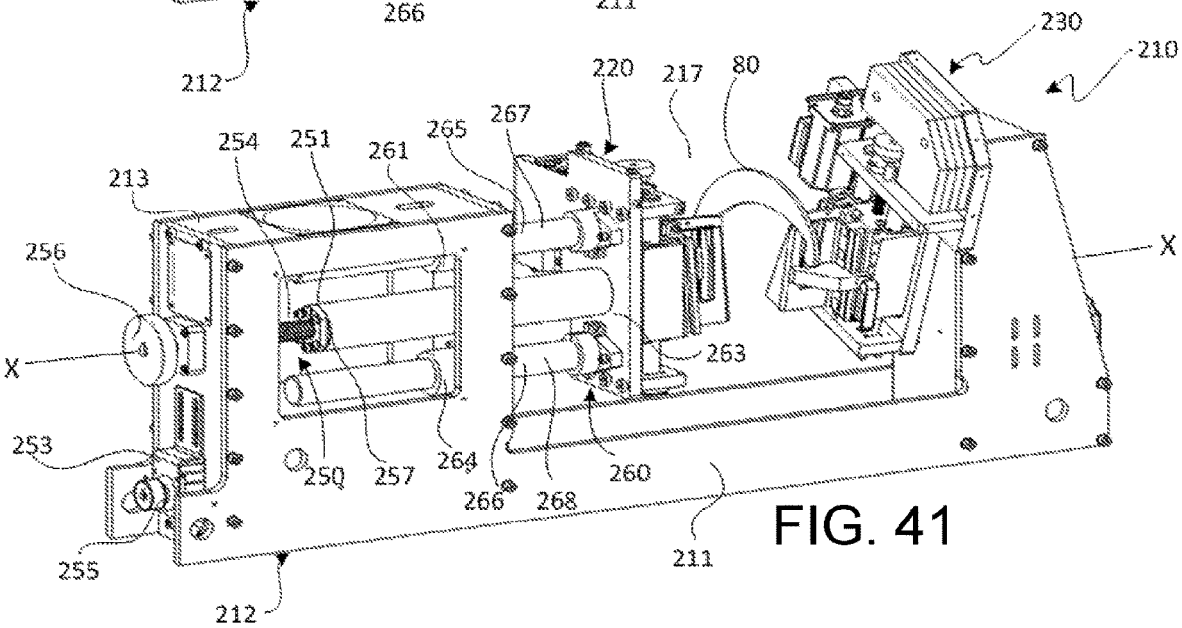
Figure 42:
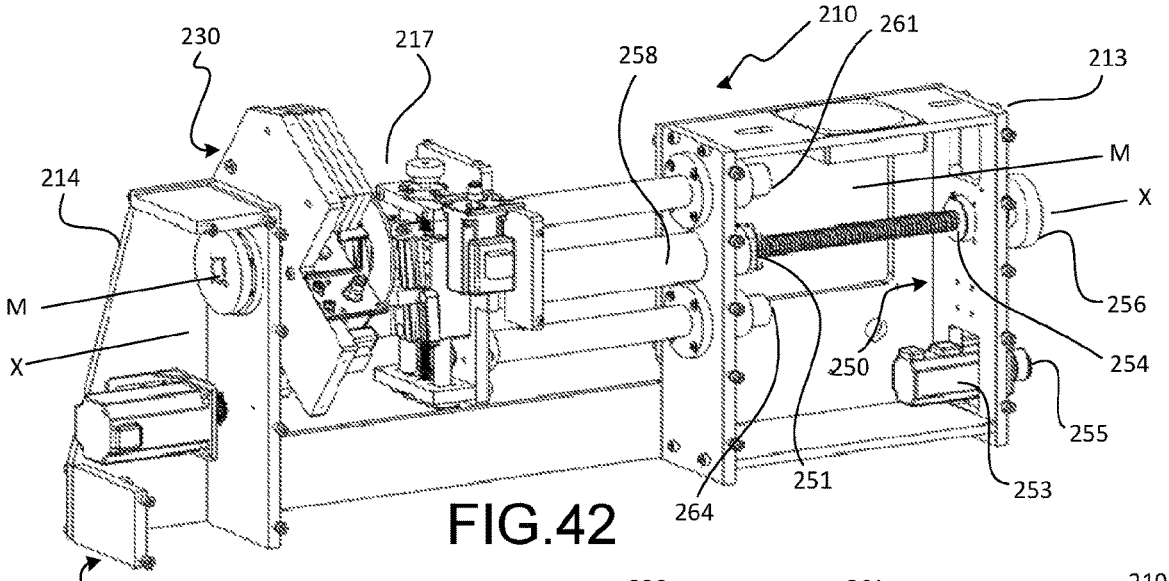
FIGS. 42 to 44 are schematic isometric views from the other end of the apparatus shown in FIGS. 39 to 41 in different positions.
Figure 43:
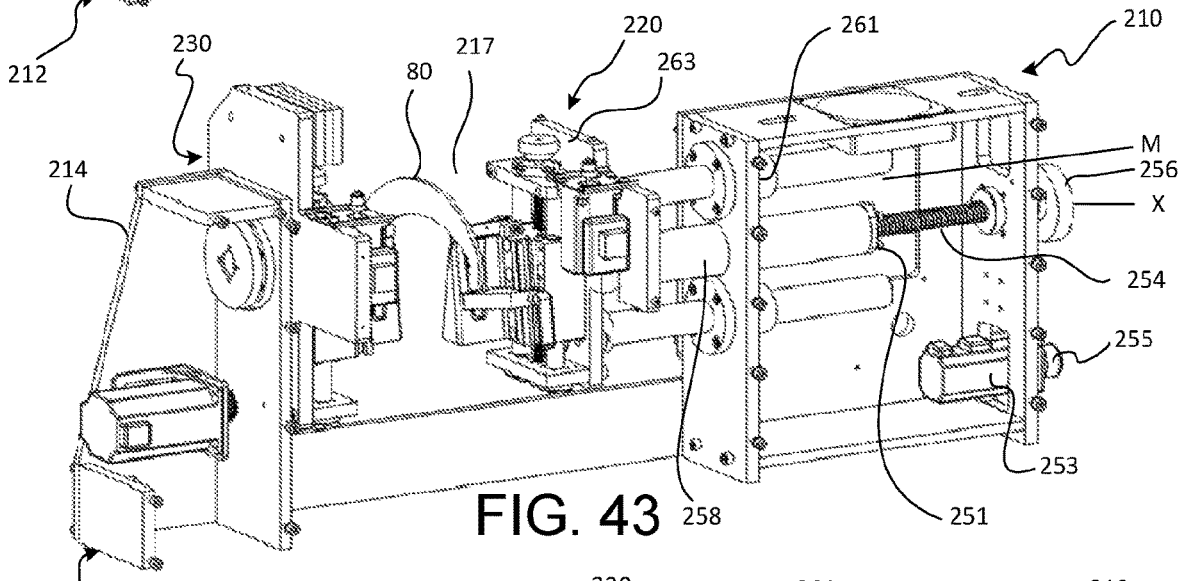
Figure 44:
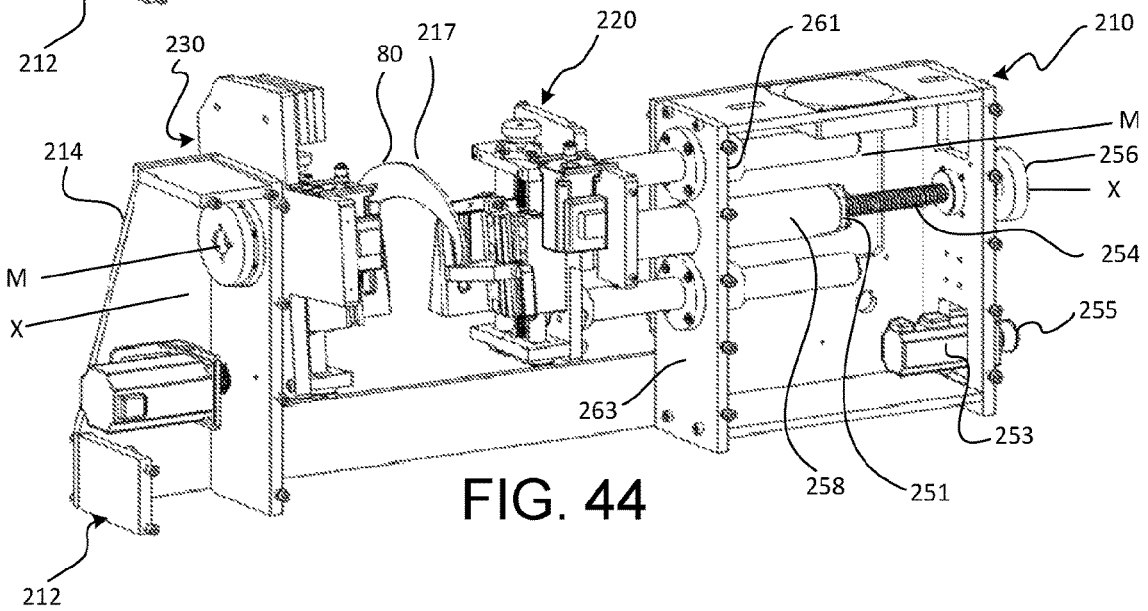

As mentioned earlier the grippers or holders 24 may be configured to compensate for blanks of different thickness. As shown in FIGS. 37 and 38 one or more of the holder components such as for example components 41 may have contact pins 99 associated therewith. The contact pins can be mounted within threaded apertures 101 so that can be moved inwardly or outwardly.

Figure 11:
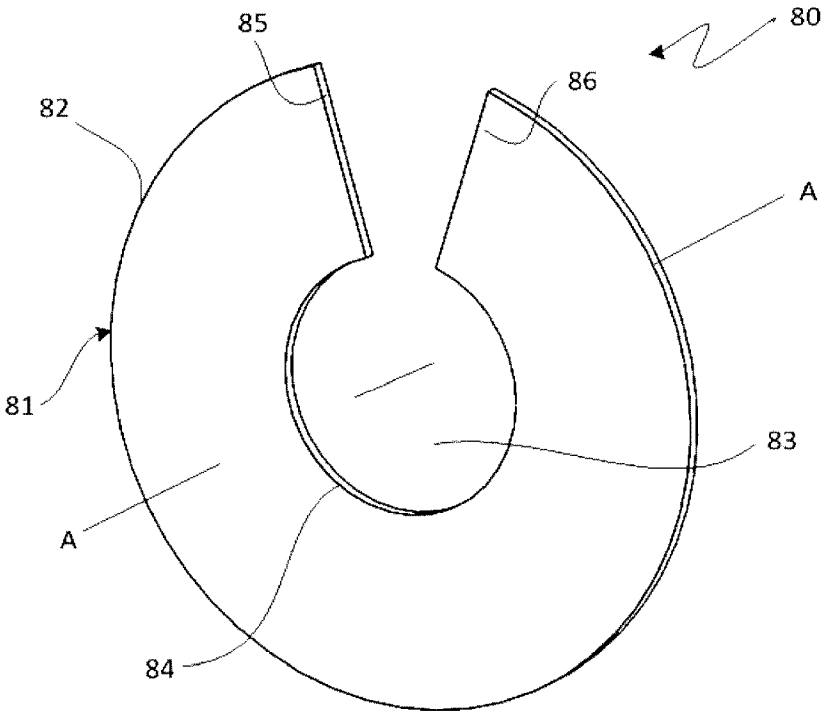
FIG. 11 is an isometric view of the blank shown in FIG. 10.
Figure 10:
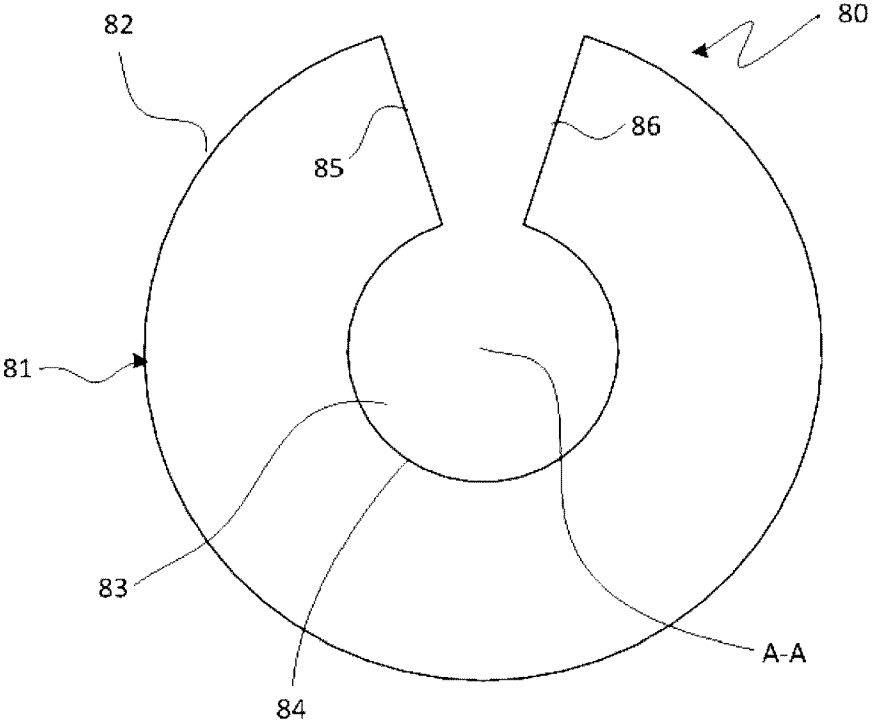
FIG. 10 is an end elevation of a blank for use with the apparatus.

FIGS. 39 to 49 illustrate a second embodiment of apparatus or machine for use in the formation of a flight of spiral, helical or screw shaped section. As is the case for the first described embodiment the flight is formed from a blank 80 as shown in FIGS. 10 and 11 which is a generally annular body 81 in the form of a disc-like member having an outer peripheral edge 82, an inner or central hole 83 having an inner peripheral edge 84 with a split from the outer to the inner edges 82 to 84 thereby providing for opposed side edges 85 and 86. In the embodiment shown the blank 80 is generally circular with an inner circular hole, the outer peripheral edge and the inner peripheral edge being circumferential edges.

In the second embodiment the apparatus or machine 210 includes a main structure, frame or housing 212 which in the form shown comprises end sections 213 and 214 and an intermediate section 211 which form a rigid structure. The structure or housing 212 includes a flight forming zone 217 between the end sections 213 and 214.

The apparatus 210 further includes a drive 250 which comprise a motor 253 arranged to power a linear actuator 251 in the form of a ballscrew 254. Power is transmitted from the motor 253 to the ballscrew 254 via a belt (not shown) which extends around pulleys 255 and 256. The ballscrew 254 includes a ballscrew nut 257 and a sleeve 258. Rotation of the ballscrew 254 causes linear movement of the nut 257 and sleeve 258 in the direction of main axis X-X.

The apparatus 210 further includes first and second support heads 220 and 230 which in use are adapted to hold the blank 80 in the region of the side edges 85 and 86; that is the support head 220 is configured so as to hold the blank 80 in a side edge region of side edge 85 and support head 230 is configured so as to hold the blank 80 in a side edge region of side edge 86. The side edge region as used herein does not necessarily mean at the side edge but includes a region spaced from the side edge. The first support head 220 is an axially displaceable head arranged for displacement or movement in the direction of the main axis X-X in response to actuation of the drive. The second support head 230 is mounted to end section so as to be inhibited from movement in the direction of the main axis X-X. The support heads 220 and 230 are best illustrated in FIGS. 45 to 52. As mentioned earlier in certain embodiments the second support head could also be mounted for axial movement.

The first support head 220 is operatively connected to the drive 250 through a mounting 260 which includes a mounting plate 263 which is operatively connected to sleeve 258. The plate 263 is carried on guides 265 and 266 which in the form shown comprise guide rods 267 and 268 and associated sleeves 261 and 264. The guide rods 267 and 268 move through guide sleeves mounting 261 and 264 during axial linear movement of sleeve 258.

Figure 45:
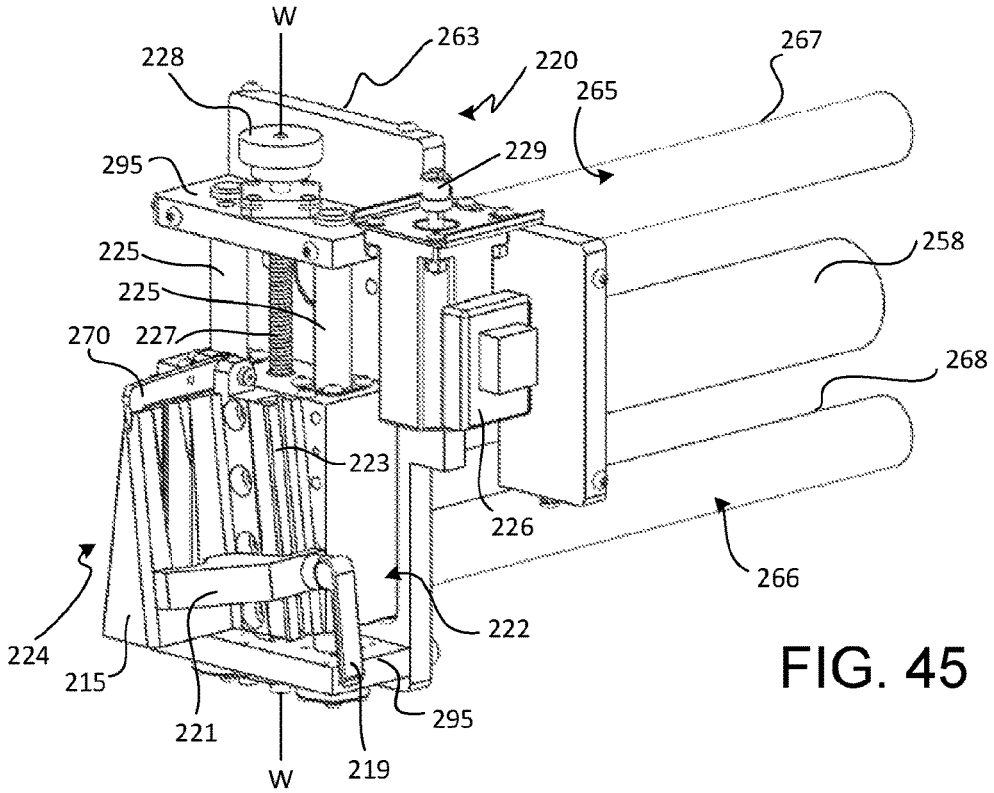
FIG. 45 is a schematic isometric view of a first support head which forms part of the apparatus shown in FIGS. 39 to 44.

The first support head 220 is shown in detail in FIG. 45 and comprises a main body 222 which is operatively mounted to mounting plate 263 in the manner hereinafter described. The first support head 220 further includes a blank gripper or holder 224 which is adapted to grip or hold the blank 80 in the region of side edge 85. As shown the blank holder 224 includes a gripper housing 215 secured or forms part of the main body 222. The blank holder 224 is adapted to grip the blank 80 and is in the form shown in FIGS. 19 to 21. A pivotally mounted latch 270 is arranged so that it can overlie the gripper 224. The latch provides additional support for part of the holder 224 when it is under load. The body portion 220 includes a ledge 221 against which the blank can be located in an initial or pre-formed position. The position of the ledge 221 is adjustable laterally with respect to the main axis X-X. As shown the ledge 221 is mounted within inclined groove or slot 223 for movement therealong. The ledge 221 can be locked in a desired position within the groove or slot 223 by lever 219.

The first support head 220 is arranged so that a lateral displacement of at least part thereof can be effected in a lateral direction with respect to main axis X-X. The lateral displacement is generally in the direction of lateral axis W-W. The lateral displacement can be effected in different ways. For example, as shown the body portion 222 can be mounted for lateral displacement. To this end the body portion 222 can be mounted on guides in the form shown comprises guide rods 225 secured to mounting plates 295 which are secured to mounting plate 263. The rods 225 extend through apertures in the main body 222 so that the main body 222 can track along the rods 225 in the direction of axis W-W. In another arrangement the blank holder 224 may be mounted to the main body 222 so as to be displaceable in the direction of the lateral axis. In another arrangement the lateral displacement could be a combination of the displacement of the main body 222 and the blank holder 224.

In this embodiment the lateral movement of the main body 222 of the first support head 220 is driven and to this end a drive motor 226 is mounted to plate 263. A drive belt (not shown) transmits power to screw 227 via pulleys 228 and 229. Rotation of the screw 227 causes movement of the main body 222 therealong in the direction of axis W-W.

Figure 46:
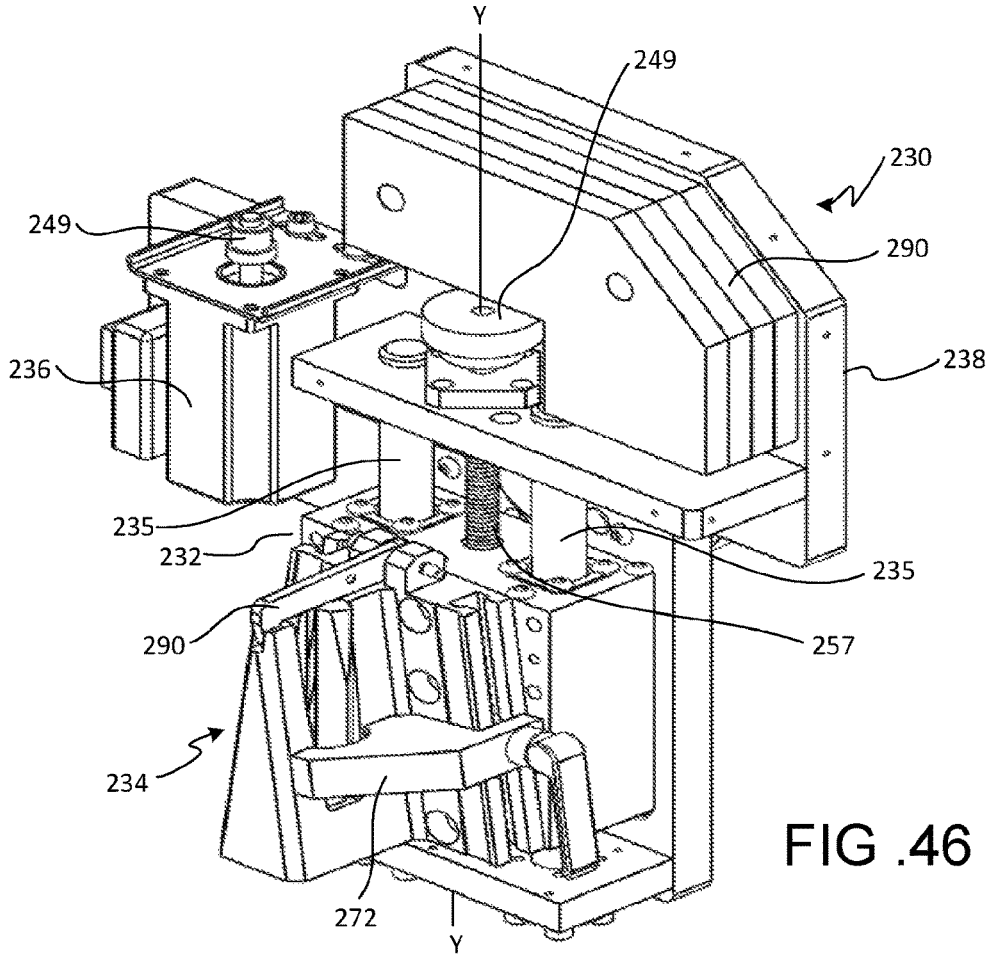
FIG. 46 is a schematic isometric view of a second support head which forms part of the apparatus shown in FIGS. 39 to 44.
Figure 47:
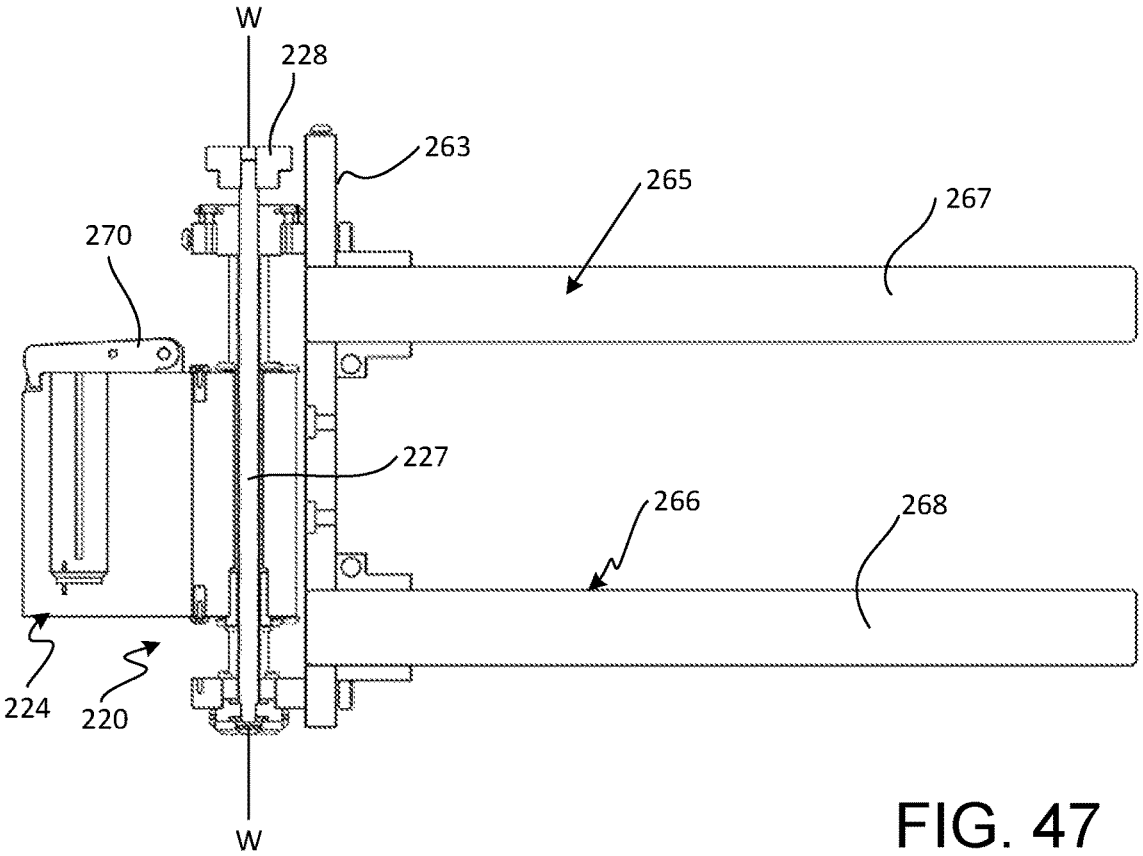
FIGS. 47 and 48 are simplified cross sections of the support head shown in FIG. 45 in different positions.
Figure 48:
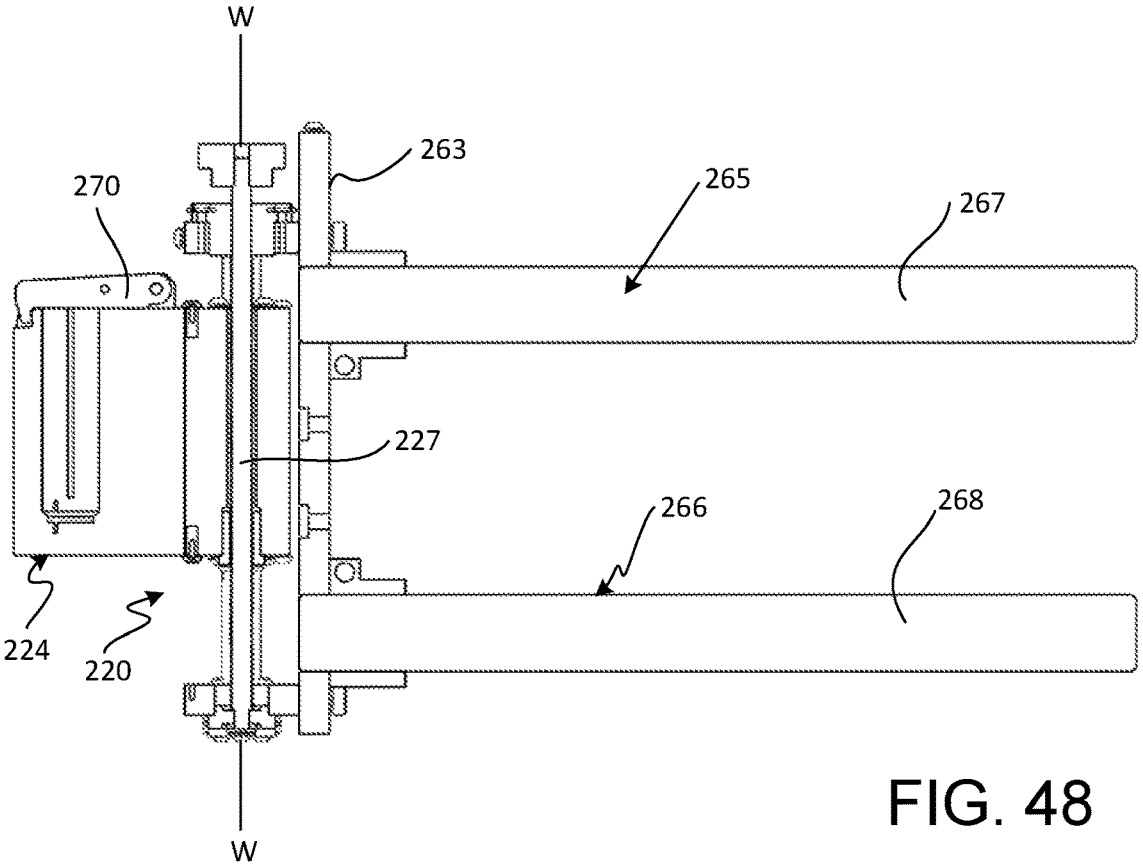
Figure 49:
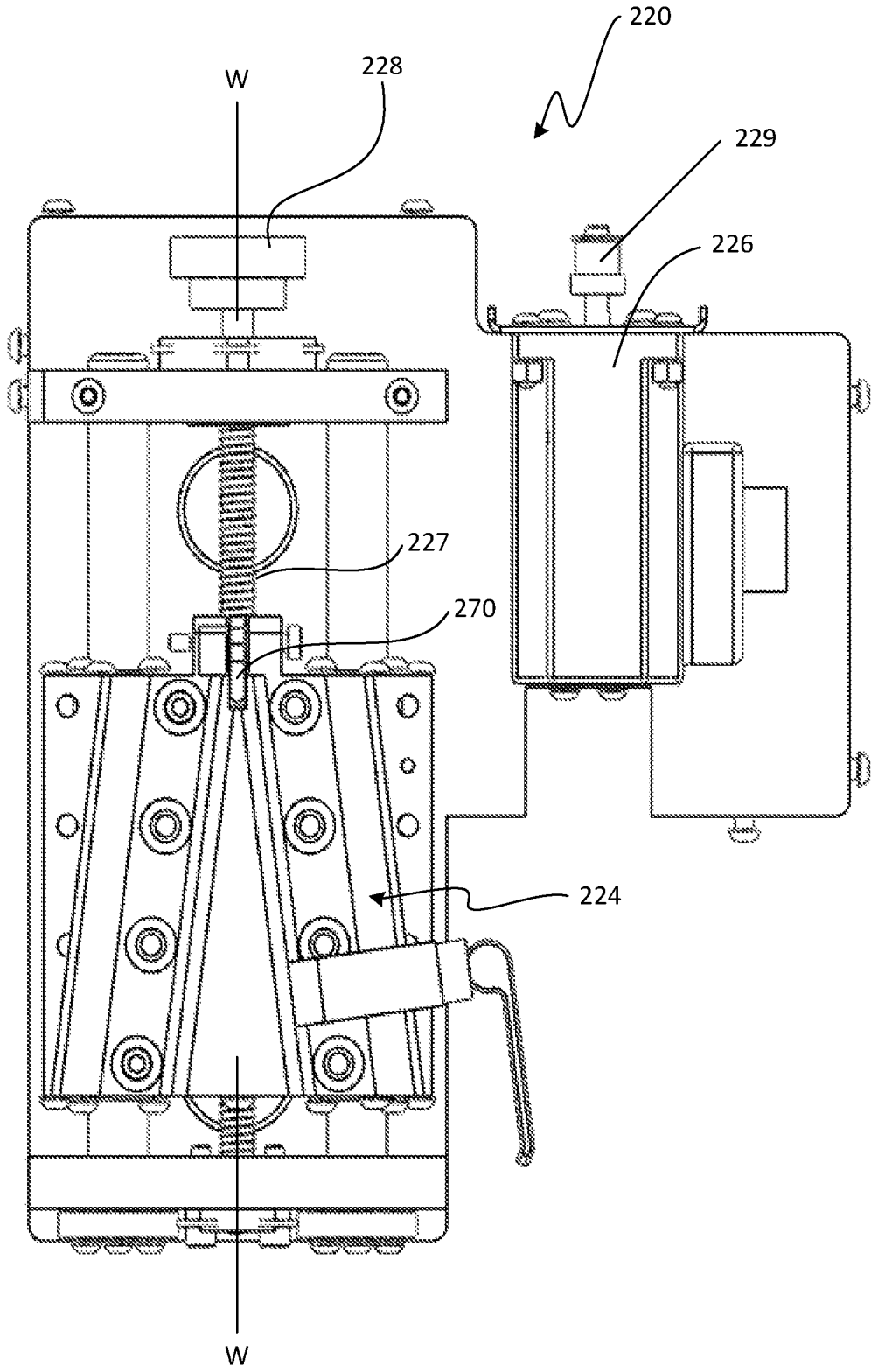
FIG. 49 is a schematic end elevation of the support head shown in FIG. 45.
Figure 52:
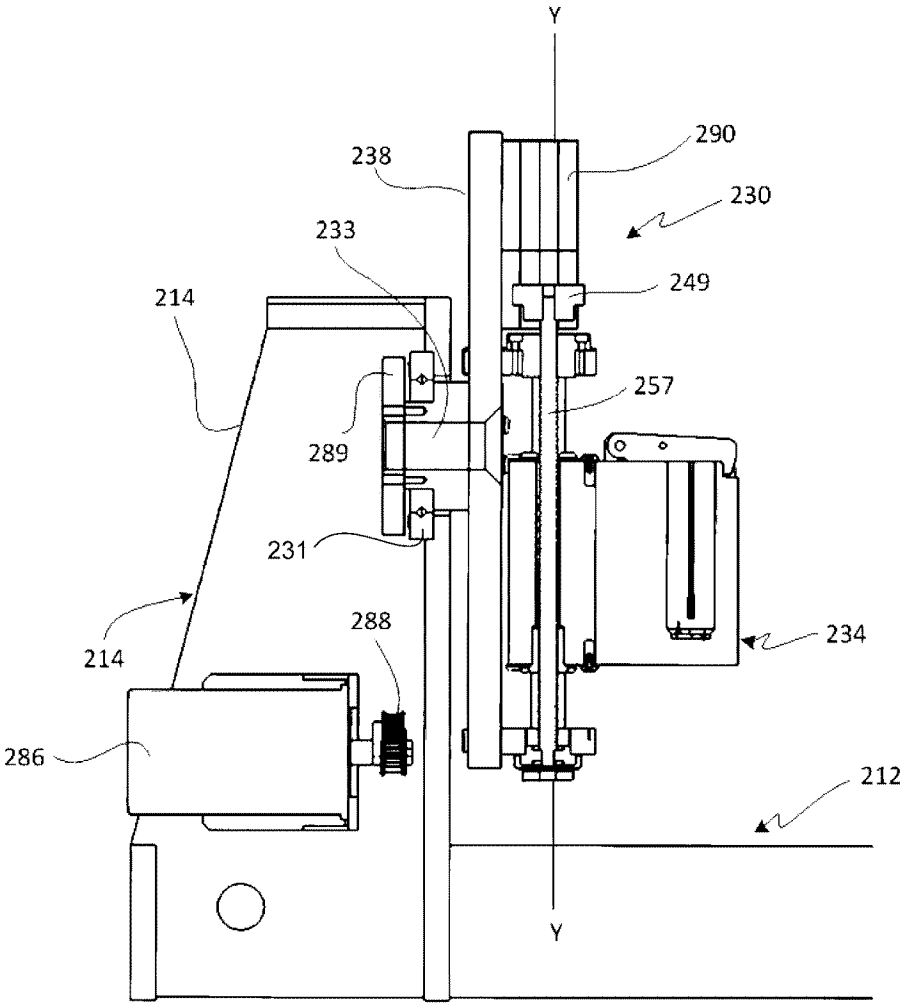
FIG. 52 is a more detailed cross section of the part shown in FIG. 46 and FIGS. 53 and 54 illustrate the changes in the profile of a helical flight during the formation process.

The second support head 230 is similar in form to the first support head 220 and is described in detail in FIG. 46. It comprises a main body 232 which is operatively mounted to end section 214 of the main structure or housing 212. The main body 232 is operatively connected to a support 238 which is mounted to the end section 214 through a shaft 233 and associated bearing 231 (FIG. 52) for rotation about an axis M-M which is parallel or co-axial with the main axis X-X. This is best illustrated in FIG. 52. The support 238 is in the form of a plate member. The body portion 232 has a ledge 272 similar to ledge 221 of the first support head 220 against which the blank 80 can be located or seated. The second support head 230 includes a blank gripper or holder 234 which is adapted to grip or hold the blank 80 in the region of side edge 86. A latch 290 which functions in the same fashion as latch 270 is also provided.

In a similar fashion to the first support head the second support head 230 is arranged so that a lateral displacement of at least part thereof can be effected. The lateral displacement is generally in the direction of axis Y-Y. Because the main body 232 can rotate about axis M-M it will be appreciated that the angular position of lateral axis Y-Y will change. The lateral displacement can be effected in different ways. For example, as shown the support head can be mounted for lateral displacement. To this end the body portion 232 can be mounted on guides in the form of guide rods 235 secured to mounting plates 237 which are secured to support plate 238. The rods 235 extend through apertures in the body portion 232 in a similar fashion as described with reference to the first support head so that the body portion can track along the rods 235. In another arrangement the blank holder 234 may be mounted to the body portion 232 so as to be displaceable in the direction of the lateral axis. In another arrangement the lateral displacement could be a combination of the displacement of the body portion 232 and the blank holder 234.

In this embodiment the rotational movement of the main body 232 of the second support head 230 is driven and to this end as shown in FIG. 52 a drive motor 286 is mounted to a wall of end section 214. A drive belt (not shown) transmits power via pulleys 288 and 289. Rotation of the pulley 289 causes rotation of the main body 232 about axis M-M.

Furthermore in this embodiment the lateral movement of the main body 232 of the second support head 230 is driven and to this end as shown in FIG. 46 a drive motor 236 is mounted to plate 238. A drive belt (not shown) transmits power to screw 257 via pulleys 248 and 249. Rotation of the screw 257 causes movement of the main body 232 therealong in the directions of axis Y-Y.

Figure 51:
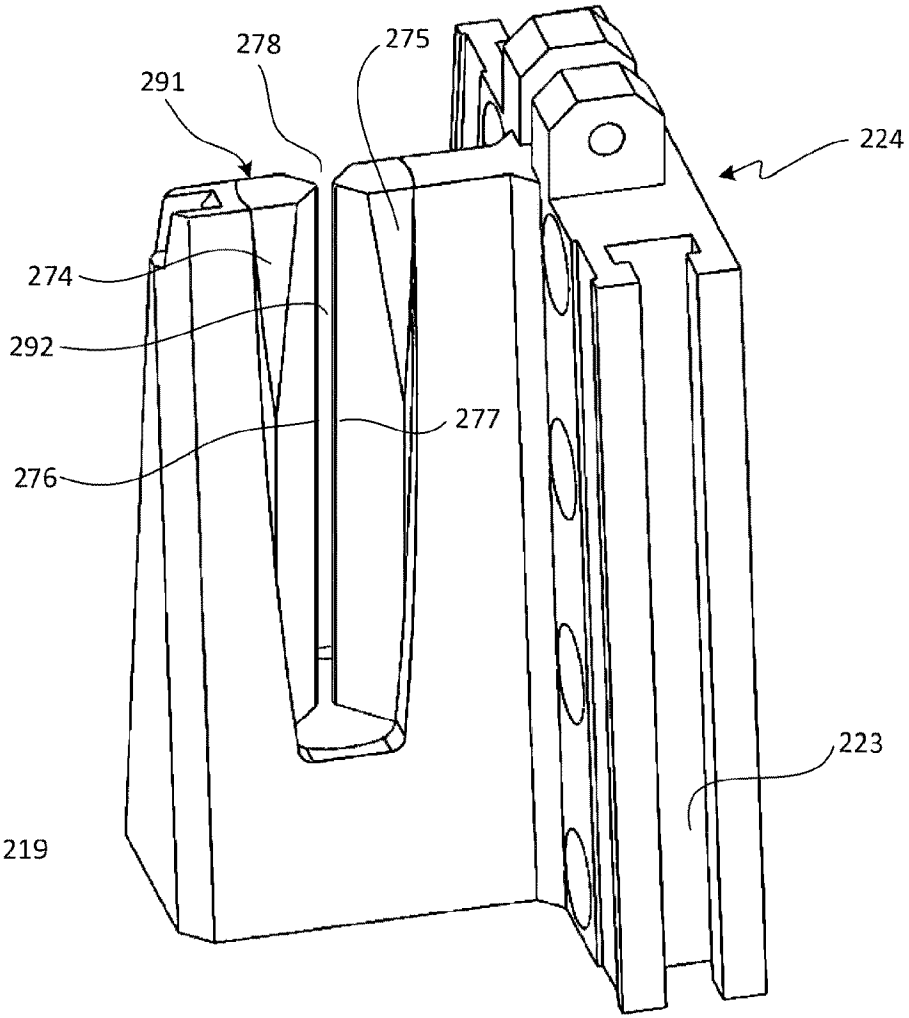
FIGS. 50 and 51 are detailed isometric views of part of the apparatus shown in FIGS. 45; and 46
Figure 50:
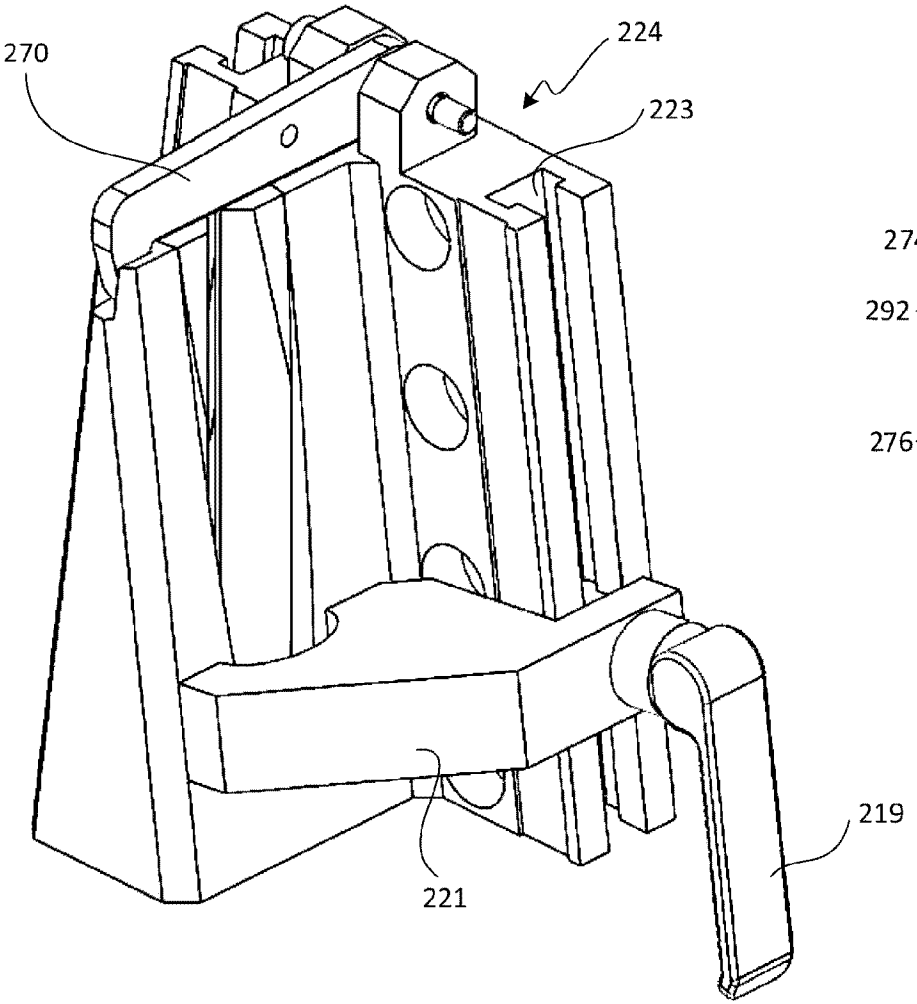

The gripper holder components in the holders 224 and 234 for each of the support heads may take several forms as have been described earlier. As best seen in FIGS. 50 and 51 the components comprise a main body 291 having a slot 292 extending from one end and having opposed sides 274 and 275 terminating at edges 276 and 277 providing for a bight 278 therebetween. The edge section of the blank 80 extends through the slot and is held in the bight 278 in a similar fashion to that shown in FIG. 21. Counterweights 290 assist in balancing the support head.

As axis X-X is drawn the helix will rotate around its axis A-A in accordance with its natural forming rotation. The outer diameter and inner diameter of the helix will decrease in accordance with its natural forming movement as axis X-X being drawn.

The natural forming rotation and diameter movements can be used to pre-determine the required movements for the apparatus axes. Points along the required movements can be used as pre-determined position values.

The required profile of the helical flight being formed takes into account various factors including the pitch, outer diameter, inner diameter, material thickness and helix direction (left hand or right hand). As a result of the nature of the material from which the helical flight may be formed control systems may be provided to take into account the effects of spring back.

One method of control is where each of the components is freely moveable except for the axial movement during the forming procedure. In this embodiment the main axis drive motor is extended to the desired position which can be below, exact or above the required calculated helical points. The calculated helical points are based on the dimension of the required helix. The main axis drive motor is then disengaged and the helix is free to naturally spring back across all axes. The positions of any or all of the axes at which the helix has sprung back to is measured by the apparatus or machine. These points are referred to as the measured spring back points. Measurement can be any means whether electronically or mechanically, such as motor encoders, linear encoders, proximity sensors, laser measurement tools, or mechanical measurement tools. The difference between the measured spring back points and the calculated helical points is taken as an adjustment factor. The main axis motor is then extended with the additional adjustment factor. The main axis motor is then disengaged and the helix is allowed to spring back to the correct position. In certain embodiments the adjustment step can be repeatable.

Another method is used wherein each component and its movement is controlled by motors. In this embodiment, the servo motors are connected to a PLC or a similar control system that enables communication and control of the motors. Pre-determined position values specify how each motor must move. The PLC or similar control system read these values and the motors run synchronously. In certain embodiments, the motors are driven to the desired position which can be below, exact or above the required calculated helical points. The calculated helical points are based on the dimensions of the required helix. The motors are then driven back to the required calculated helical points. Therefore, when the motors are driven to the calculated helical points, the blank will form a substantially perfect helix as material spring back has been driven.

In another control system the motors are driven to the desired position which can be below, exact or above the required calculated helical points. The calculated helical points are based on the dimensions of the required helix. The motors are then disengaged and the helix is free to naturally spring back. The points at which the helix has sprung back to is measured by the machine. Measurement can be any means whether electronically or mechanically, such as motor encoders, linear encoders, proximity sensors, laser measurement tools, or mechanical measurement tools. The difference between the measured spring back points and the required calculated helix is taken as an adjustment factor. The motors are then driven with the additional adjustment factor. The motors are then disengaged and the helix is allowed to spring back to the correct position. In certain embodiments the adjustment step can be repeatable.

In yet another control system, the force on axis X-X is measured whilst motors are driving and forming the helix. Measurement can be any means whether electronically or mechanically, such as motor driver, torque sensor, mechanical switch, or mechanical torque measurement tool. The motors are driven to the desired position which can be below, exact or above the required calculated helical points. The calculated helical points are based on the dimensions of the required helix. The motors then begin driving back until the force on axis X-X goes to minimal, negative or significant drop in force, the position of the helix and/or motor is measured. These points are referred to as the measured spring back points. Measurement can be any means whether electronically or mechanically, such as motor encoders, linear encoders, proximity sensors, laser measurement tools, or mechanical measurement tools. The difference between the measured spring back points and the calculated helical points is taken as an adjustment factor. The motors are then driven with the additional adjustment factor. The motors then begin driving to either the required calculated helical points (which now includes the additional adjustment factor) and/or driven back until the force on axis X-X goes to minimal, negative or significant drop in force, the motors stop. This will allow the helix to be in the correct position. In certain embodiments the adjustment step can be repeatable.

The preferred method is in the case where the components are freely moveable with respect to their respective axes (with the exception of the driven axial movement) although driven movement is required for some applications. In all cases the grippers allow for substantially rotational movement of the helix edges or close thereto during the formation process.

It will be appreciated from the foregoing that the mounting of the two support heads is such so as to provide for a series of position adjustments which enable the natural or true shape of the flight to be substantially maintained during the formation process. The first support head has three position adjustments or degrees of freedom. The first is the axial displacement of the body portion. The second and third are the axial displacement of the holders and the independent rotation of the holder elements. The second support head has four position adjustments. The first is the rotation of the support head about an axis which is coaxial or parallel with the main axis. The second is the axial displacement of the body portion and the third and fourth are axial displacement of the holder elements and independent rotation of those elements.

The various embodiments described may provide for one or more of the following advantages. In certain embodiments the apparatus enables an annular flat disc or blank to be shaped into a mathematically defined helical shape of a certain thickness, so that the physical shape attains the theoretical model. Furthermore the apparatus in certain embodiments enables the formation of a sectional flight in one continuous movement and to attain as substantially or close to flawless side edge and fit conditions (true helix edges). In certain embodiments the freely moving independent heads also allow for the sectional flight to naturally springback and therefore can account for difference in material elasticity. This information is incorporated to automatically adjust the forming to achieve perfect helix formation with linear and/or non-linear material deformation. The above leads to high quality flights, substantially the same or identical corresponding flight edges for continuous segments, quicker flight production (no setup time, and faster flight forming). No re-forming is required due to automatic compensation of "springback" (material elasticity), no forming dies or die plates are required for both standard and canted flights, no slippers of packers needed, no operator interaction during forming thereby substantially reducing or eliminating human error, no safety speed limit is required for moving parts as operator is physically isolated from moving parts.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Table of Parts

| | |
|---|---|
| Apparatus | 10 |
| Main structure/housing | 12 |
| End walls | 13/14 |
| Side walls | 15/16 |
| Compartment | 18 |
| Main axis | X-X |
| Flight forming zone | 17 |
| First support head | 20 |
| Body portion | 22 |
| Block like member | 23 |
| Ledge | 21 |
| Lateral displacement axis | W-W |
| Gripper/holder | 24 |
| Guide rods | 25 |
| Mounting plates | 28 |
| Apertures | 29 |
| Second support head | 30 |
| Body portion | 32 |
| Block like member | 33 |
| Lateral displacement axis | Y-Y |
| Gripper/holder | 34 |

-continued

Table of Parts

| | |
|---|---|
| Guide rods | 35 |
| Support plate member | 38 |
| Mounting plates | 36 |
| Apertures | 39 |
| Rotation axis | M-M |
| Drive | 50 |
| Linear actuator | 51 |
| Connecting rod | 52 |
| Mounting | 60 |
| Mounting member | 62 |
| Plate | 63 |
| Guides | 65/66 |
| Guide rods | 67/68 |
| Sleeves | 61/64 |
| Coupling | 69 |
| Axis | A-A |
| Blank | 80 |
| Annular body | 81 |
| Outer peripheral edge | 82 |
| Inner hole | 83 |
| Inner peripheral edge | 84 |
| Side edges | 85/86 |
| Holder components | 41 |
| Pivot axes | P-P |
| Holder elements | 43/44 |
| Outer side wall | 45 |
| Inner side wall | 46 |
| End walls | 48/49 |
| Inclined sections | 53/54 |
| Edge | 55 |
| Gap/bight | 56 |
| Outer wall | 91 |
| End walls | 92/93 |
| Slot | 94 |
| Mouth | 95 |
| Sides | 96/97 |
| Main body | 71 |
| Slot | 72 |
| End | 73 |
| Sides | 74/75 |
| Edges | 76/77 |
| Gap or bight | 78 |
| Housing cavity | 79 |
| Access slots | 98 |
| Contact pins | 99 |
| Apertures | 101 |
| Apparatus | 210 |
| Main structure or housing | 212 |
| End sections | 213/214 |
| Intermediate section | 211 |
| Flight forming zone | 217 |
| Drive | 250 |
| Motor | 253 |
| Linear actuator | 251 |
| Ballscrew | 254 |
| Pulleys | 255/256 |
| Ballscrew nut | 257 |
| Sleeve | 258 |
| First support head | 220 |
| Second support head | 230 |
| Mounting | 260 |
| Mounting plate | 263 |
| Guides | 265/266 |
| Mounting sleeves | 261/264 |
| Guide sleeves | 267/268 |
| Main body | 222 |
| Blank gripper or holder | 224 |
| Housing | 215 |
| Ledge | 221 |
| Groove or slot | 223 |
| Lever | 219 |
| Guide rods | 225 |
| Mounting plates | 295 |
| Latch | 270 |
| Drive motor | 226 |
| Screw | 227 |
| Pulleys | 228/229 |

-continued

| Table of Parts | |
|---|---|
| Main body | 232 |
| Support | 238 |
| Plate member | 237 |
| Shaft | 233 |
| Bearing | 231 |
| Ledge | 272 |
| Latch | 290 |
| Blank holder | 234 |
| Gripper elements | 231 |
| Motor | 246 |
| Pulleys | 248/249 |
| Motor | 286 |
| Pulleys | 288/289 |
| Bight | 278 |
| Main body | 291 |
| Slot | 292 |
| Sides | 274/275 |
| Edges | 276/277 |
| Bight | 278 |
| Counterweight | 290 |
| Bearing | 231 |

The invention claimed is:

1. A flight forming apparatus for the formation of a helical screw flight from a blank having an outer peripheral edge, a central hole having an inner peripheral edge, and a split extending from the outer peripheral edge to the inner peripheral edge of the blank so as to provide for opposed side edge sections, the apparatus comprising:

a drive;

first and second support heads that are configured to hold the blank at the opposite side edge sections, wherein the first and second support heads are movable relative to one another in an axial direction of a main axis from a pre-forming position towards a formed position, wherein when in the pre-forming position the support heads are disposed adjacent each other so as to be at least partially side by side while holding the blank, wherein when the drive is actuated the first and second support heads move relative to one another and axially away from each other in the axial direction of the main axis from the pre-forming position towards the formed position during formation of the helical screw flight;

wherein the first and second support heads are further configured so as to be able to provide for a plurality of position adjustments including a lateral position adjustment whereby the first and second support heads can be displaced or moved laterally with respect to the main axis in a direction of respective lateral axes during formation of the helical screw flight while the first and second support heads move relative to one another in the direction of the main axis from the pre-forming position towards the formed position and a rotational position adjustment wherein at least one of the first and second support heads can be rotated about a rotation axis which extends in a direction parallel to or coaxial with the main axis while the first and second support heads move relative to one another in the direction of the main axis from the pre-forming position towards the formed position during formation of the helical screw flight from the blank, and wherein when in the pre-forming position the first and second support heads and the blank are positioned in a plane that is perpendicular to the main axis; and a control system that controls relative movement of the support heads away from one another in the axial direction of the main axis from the pre-forming position so that the side edge sections of the blank are moved relative to one another in the axial direction of the main axis to a position where the helical flight is formed.

2. The apparatus according to claim 1, wherein the first support head is operatively connected to the drive so as to be movable in the direction of the main axis in response to actuation of the drive and the second support head is operatively mounted so that axial movement in the direction of the main axis is inhibited.

3. The apparatus according to claim 1, wherein the drive comprises a linear actuator.

4. The apparatus according to claim 1, wherein the first support head comprises a main body mounted so as to be movable in a direction of its associated lateral axis.

5. The apparatus according to claim 4, wherein the first support head comprises a holder operatively mounted to the main body so as to be movable in a direction of its associated lateral axis.

6. The apparatus according to claim 4, wherein the second support head comprises a main body mounted so as to be movable in the direction of the lateral axis.

7. The apparatus according to claim 1, wherein the first support head comprises a holder operatively mounted to the main body, the holder comprising a plurality of holder components mounted so as to be independently pivotable relative to one another about a pivot axis which extends parallel with the lateral axis.

8. The apparatus according to claim 7, wherein the main body of the second support head is mounted for rotation about the rotation axis.

9. The apparatus according to claim 1, wherein the second support head comprises a holder operatively mounted to the main body so as to be movable in a direction of the lateral axis.

10. The apparatus according to claim 9, wherein the second support head comprises a holder operatively connected to the main body, the holder comprising a plurality of holder components mounted so as to be independently pivotable relative to one another about a pivot axis which extends parallel to the lateral axis.

11. The apparatus according to claim 1, including a main structure, the drive and first and second support members being operatively mounted to the main structure.

12. The apparatus according to claim 1, wherein the lateral movement of the first and second support heads in the direction of the lateral axes is free movement absent of a drive.

13. The apparatus according to claim 1, wherein the rotation of one of the support heads about the rotation axis is free movement absent of a drive.

14. The apparatus according to claim 1, wherein the lateral movement of the first and second support heads in the direction of the lateral axes is driven movement effected by a drive.

15. The apparatus according to claim 14, wherein the rotation of one of the support heads about the rotation axis is driven movement effect by a drive.

16. The apparatus according to claim 14, wherein each driven movement is effected by a separate or different drive.

17. The apparatus according to claim 1, wherein the first support head comprises a holder operatively mounted to the main body of the first support head the holder comprising an elongated body having opposed ends, a slot extending from one end towards and terminating short of the other end, the slot when viewed from said one end comprising opposed V-shaped sides terminating at spaced apart inner edges so as to provide for a gap or bight therebetween, the slot being configured so that one of the side sections of the blank extend through the slot and is held in the bight, the arrangement being such that it allows for uniform rotation of the side edge of the blank so that interference occurs.

18. The apparatus according to claim 17, wherein the second support head comprises a holder operatively mounted to the main body of the second support head the holder comprising an elongated body having opposed ends, a slot extending from one end towards and terminating short of the other end, the slot when viewed from said one end comprising opposed V-shaped sides terminating at spaced apart inner edges so as to provide for a gap or bight therebetween, the slot being configured so that one of the side sections of the blank extend through the slot and is held in the bight, the arrangement being such that it allows for uniform rotation of the side edge of the blank so that interference occurs.

19. The apparatus according to claim 1, comprising a compensating arrangement for compensating for a calculated spring back effect resulting from elasticity or resilience of the blank from which the helical screw flight is formed.

* * * * *